US009914199B2

(12) United States Patent
Vela et al.

(10) Patent No.: US 9,914,199 B2
(45) Date of Patent: Mar. 13, 2018

(54) ABRASIVE DISC

(71) Applicants: SAINT-GOBAIN ABRASIVES, INC., Worcester, MA (US); SAINT-GOBAIN ABRASIFS, Conflans-Sainte-Honorine (FR)

(72) Inventors: Godofredo Vela, New Braunfels, TX (US); Brian J. Wahl, Bellevue, WA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 204 days.

(21) Appl. No.: 14/565,201

(22) Filed: Dec. 9, 2014

(65) Prior Publication Data

US 2015/0158149 A1 Jun. 11, 2015

Related U.S. Application Data

(60) Provisional application No. 61/913,800, filed on Dec. 9, 2013.

(51) Int. Cl.
*B24D 7/18* (2006.01)
*B24D 13/08* (2006.01)
(Continued)

(52) U.S. Cl.
CPC ..... *B24D 13/08* (2013.01); *B24D 7/18* (2013.01); *B24D 13/142* (2013.01); *B24D 99/005* (2013.01); *B24D 2203/00* (2013.01)

(58) Field of Classification Search
CPC ..... B24B 37/16; B24D 5/066; B24D 5/14; B24D 7/14; B24D 7/18; B24D 11/04;
(Continued)

(56) References Cited

U.S. PATENT DOCUMENTS 1,526,861 A * 2/1925 Manderscheid ..... B24D 13/08 451/542
2,781,618 A 3/1956 Larson
(Continued)

FOREIGN PATENT DOCUMENTS

EP 0459699 A1 12/1991
EP 1106102 A2 6/2001
WO 9803308 A1 1/1998

*Primary Examiner* — Timothy V Eley
(74) *Attorney, Agent, or Firm* — Abel Law Group, LLP

(57) ABSTRACT

An abrasive article including a disc including a central axis; a primary outer edge substantially coaxial with the central axis and having a circumferential length, $L_1$; a secondary outer edge substantially coaxial with the central axis and coplanar with the primary outer edge, the secondary outer edge having a circumferential length, $L_2$, wherein $L_2$ is less than $L_1$; and a structurally weakened portion extending substantially adjacent to the secondary outer edge. In an embodiment, the abrasive article further includes a shedable portion configured to rupture the structurally weakened portion when the shedable portion is removed from the abrasive disc. In another aspect, an abrasive article having an initial outer circumferential length, $L_I$, and a length of deliberately exposable circumferential edge surface, $L_{OE}$, wherein $L_{OE}$ is greater than $L_I$.

12 Claims, 9 Drawing Sheets

(51) Int. Cl.
*B24D 13/14* (2006.01)
*B24D 99/00* (2010.01)

(58) Field of Classification Search
CPC ..... B24D 11/06; B24D 13/08; B24D 13/142; B24D 99/005; B24D 2203/00
See application file for complete search history.

(56) References Cited

U.S. PATENT DOCUMENTS 2,800,751 A 7/1957 Brucker
2,991,596 A 7/1961 Walters
3,026,655 A * 3/1962 Osenberg ..... B24D 7/063 125/5
3,053,063 A 9/1962 Lilleberg
3,121,298 A * 2/1964 Mellon ..... B24D 11/00 451/539
3,823,516 A 7/1974 Christian
3,851,357 A 12/1974 Ribich et al.
4,182,616 A * 1/1980 Gadbois ..... A47L 11/164 451/527
5,123,139 A 6/1992 Leppert et al.
5,150,546 A 9/1992 Tucker
5,201,785 A 4/1993 Nagano
5,249,329 A 10/1993 Arnold
6,081,959 A 7/2000 Umbrell
6,105,197 A 8/2000 Umbrell
6,116,996 A 9/2000 Yanase
6,120,352 A * 9/2000 Duescher ..... B24B 37/042 451/287
6,332,836 B1 12/2001 Tseng
6,561,890 B2 * 5/2003 Tominaga ..... B24B 37/24 451/526
6,929,538 B2 8/2005 Yi
6,979,248 B2 * 12/2005 Hu ..... B23H 5/08 204/224 M
7,004,823 B2 * 2/2006 Kisboll ..... B24D 11/04 451/461
8,113,920 B2 2/2012 Gissing
2001/0024878 A1 * 9/2001 Nakamura ..... B23H 5/08 438/691
2007/0204420 A1 * 9/2007 Hornby ..... B24B 37/24 15/230
2009/0104862 A1 4/2009 MacKay
2009/0191376 A1 7/2009 Rivard et al.
2010/0144253 A1 6/2010 Umbrell
2010/0267319 A1 10/2010 Ferronato et al.
2015/0158142 A1 6/2015 Vela et al.
2016/0114458 A1 * 4/2016 Bajaj ..... B24B 37/26 51/298

* cited by examiner

ABRASIVE DISC

CROSS-REFERENCE TO RELATED APPLICATION

The present application claims priority from U.S. Provisional Patent Application No. 61/913,800, filed Dec. 9, 2013, entitled "ABRASIVE ARTICLE", naming as inventors Godofredo Vela and Brian J. Wahl, which application is incorporated by reference herein in its entirety.

FIELD OF THE DISCLOSURE

The present disclosure relates to abrasive articles, and more particularly to abrasive articles having enhanced features.

RELATED ART

Abrasive articles are used in various industries to machine work pieces. Machining utilizing abrasive articles spans a wide industrial scope from the optics and automotive paint repair industries, to the metal fabrication industries and aerospace industries. Machining, such as by hand or with use of commonly available tools such as orbital sanders (both random and fixed orbits), and belt and vibratory sanders, is also commonly done by consumers in household applications. In each of these examples, abrasives are used to remove bulk material and/or affect surface characteristics of products (e.g., planarity, surface roughness).

Surface characteristics include shine, texture, and uniformity. In particular, surface characteristics, such as roughness and gloss, are measured to determine quality in the automotive paint repair industries and the aerospace machining industries. For example, when painting or finishing a surface, paint or some other surface material is typically sprayed or coated on the surface and cured. The resulting surface can have a pock-marked orange peel texture or encapsulated dust defects. Typically the surface is first sanded with a course grain abrasive and subsequently, sanded with fine grain engineered abrasives and buffed with wool or foam pads. Hence, the abrasive surface of the abrasive article generally influences surface quality.

Various types of automated processing systems have been developed to abrasively process articles of various compositions and configurations. Different operations require different abrasives and different abrasive configurations.

As such, a precise aligning, quick attachment abrasive article that can provide improved surface characteristics is desirable. Moreover, abrasive articles that include enhanced abrasive surfaces adapted for extended and/or multifunctional operational use are desirable.

BRIEF DESCRIPTION OF THE DRAWINGS

Embodiments are illustrated by way of example and are not limited in the accompanying figures.

DETAILED DESCRIPTION

Figure 1A:
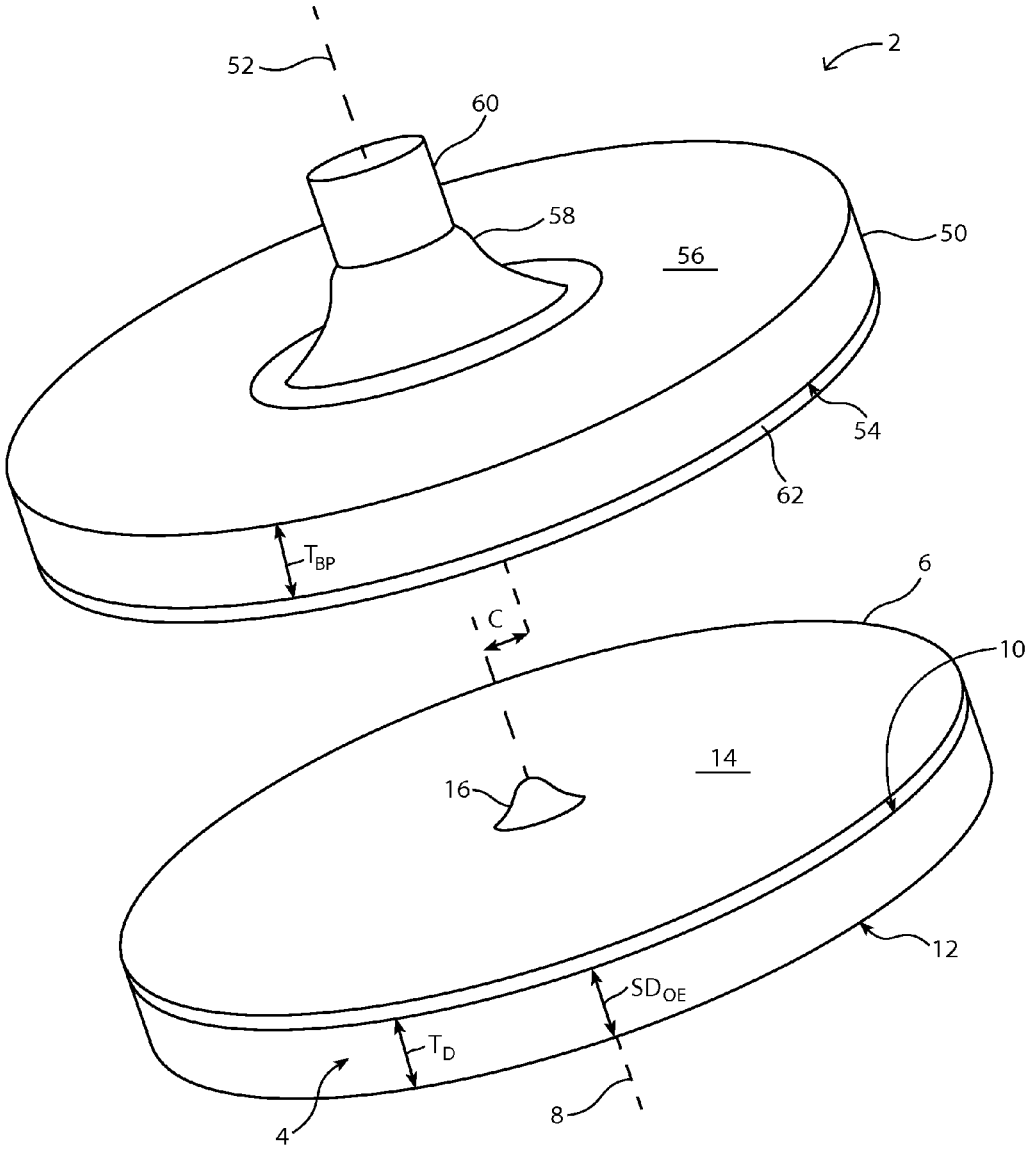
FIG. 1A includes an exploded perspective view of an abrasive assembly in accordance with an embodiment.

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the abrasive arts.

As used herein, "concentricity tolerance" specifies a cylindrical tolerance zone whose axis coincides with a datum axis and within which all cross-sectional axes of the feature being controlled must lie. The tolerance zone is equally disposed about the datum axis for concentricity. The concentricity requires that the median points of the controlled feature, regardless of its size, to be within the tolerance zone. Concentricity tolerance, as used herein, is a measure of relative scale. For example, a cylindrical disc with a radius of 10 inches having a central axis with a concentricity tolerance of 10%, or 0.1, can be understood as having a cylindrical tolerance zone centered on the axis with a radius of 1 inch. Therefore, a concentricity tolerance of 10% on a cylindrical disc with a radius of 10 inches requires the datum axis to be within 1 inch of the central axis of the cylindrical disc. It should be understood that concentricity tolerance can also be defined as a function of runout. The calculation of runout, which will be described in greater detail below, may be more easily obtained than directly measuring concentricity and will have twice the value as the concentricity tolerance between two axes. As used herein, "concentricity" refers to the actual geometrical offset exhibited between two axes.

In a first aspect, an abrasive assembly can include a generally cylindrical abrasive disc engaged with a generally cylindrical back-up pad. Both the abrasive disc and the back-up pad can each contain a complementary engagement component and a complementary alignment element. Both the abrasive disc and the back-up pad can define a central axis and an outermost radial edge. The complementary alignment element of the back-up pad can mate with, or align with, the complementary alignment element of the abrasive disc during connection of the abrasive disc with the back-up pad, thereby permitting a self-centering aspect of the abrasive assembly. In particular embodiments, the abrasive assembly can have a low assembled concentricity (e.g., about 0.5%), as measured by the offset of the axis of the abrasive disc and the axis of the back-up pad. In yet further embodiments, a plurality of abrasive assemblies can have a low concentricity (e.g., about 0.5%) with a low standard deviation (e.g., about 0.001) therebetween. Moreover, each abrasive assembly can be assembled in a short period of time (e.g., less than five seconds, such as less than four seconds, less than three seconds, or even less than two seconds), as measured by an amount of time required to align and engage the abrasive disc with the back-up pad.

In another aspect, the abrasive disc of the abrasive assembly can comprise at least one structurally weakened portion generally coaxial with the central axis of the abrasive disc. In a particular embodiment, the weakened portion can extend axially through the thickness of the abrasive disc. The weakened portion can have a reduced strength as compared to the remainder of the abrasive disc, thereby allowing an operator to selectively remove a portion of the abrasive disc and reveal a second outer (previously notional) edge previously hidden within the abrasive disc.

Referring now to the drawings, FIG. 1A shows an exploded perspective view of an abrasive assembly 2 in accordance with an embodiment. The abrasive assembly 2 can generally include an abrasive disc 6 and a back-up pad 50.

Figure 1B:
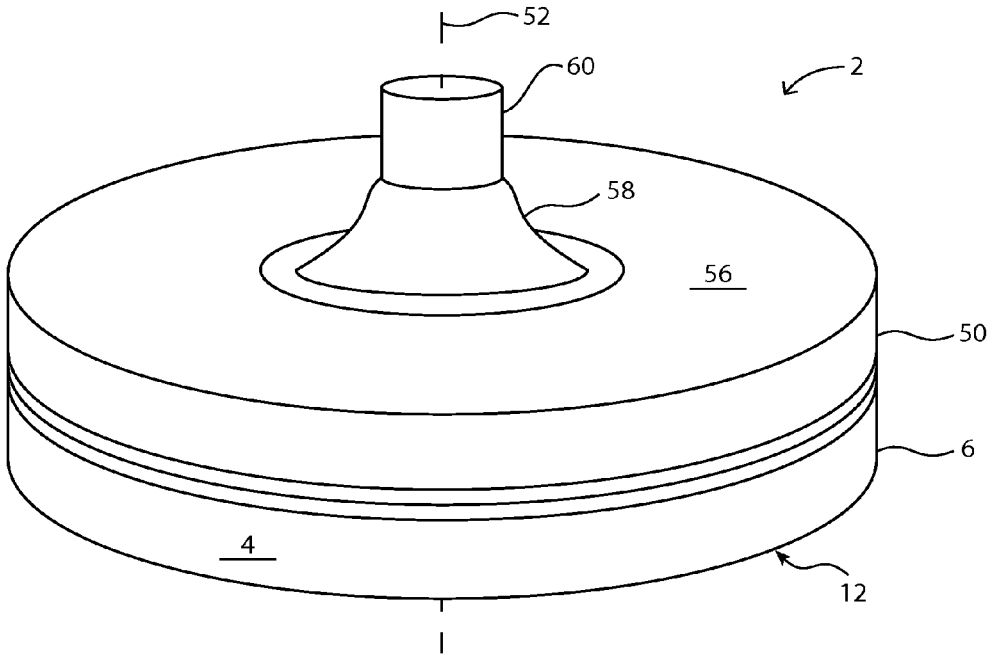
FIG. 1B includes a perspective view of an abrasive assembly in accordance with an embodiment.

FIG. 1B shows a perspective view of the abrasive assembly 2 in the assembled state. In such a manner, the abrasive assembly 2 can be rotated around a central axis 52 of the back-up pad 50 to operatively affect the surface characteristics of a work piece (not shown).

Abrasive Disc

Figure 2:
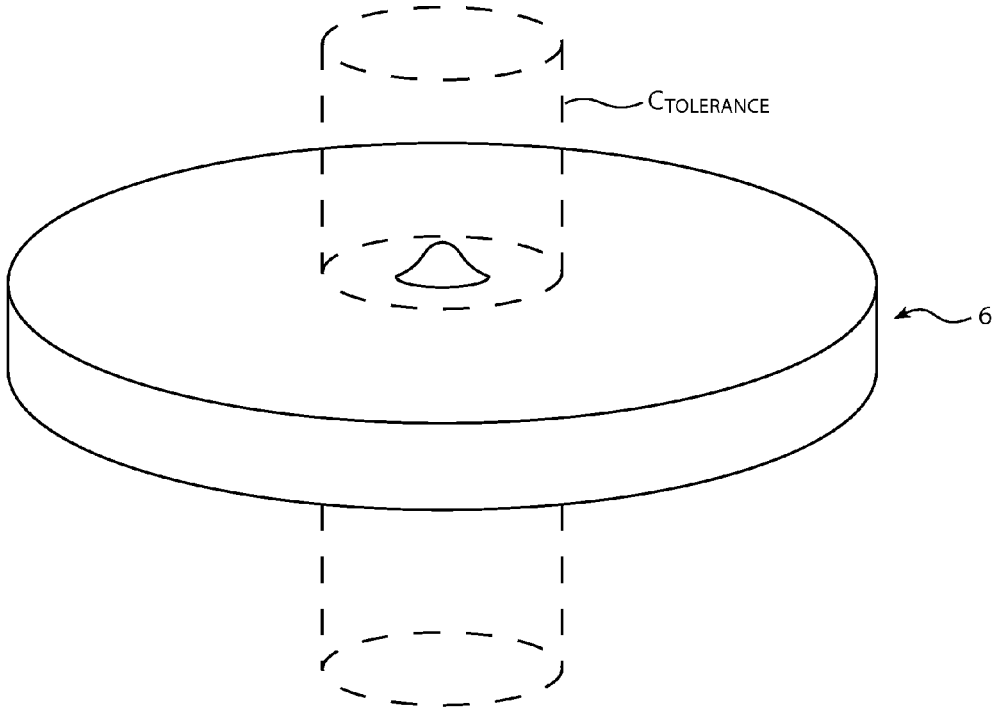
FIG. 2 includes a perspective view of an abrasive disc in accordance with an embodiment.

FIG. 2 shows a perspective view of an abrasive disc 6 in accordance with an embodiment herein. In a particular aspect, the abrasive disc 6 can comprise a concentricity tolerance area, $C_{TOLERANCE}$, as defined by a generally cylindrical volume extending from the abrasive disc 6 in a direction generally perpendicular therewith. The area, $C_{TOLERANCE}$, can have a defined width into which the central axis of the back-up pad can be received during assembly of the abrasive assembly. It should be understood that a smaller diametrical value for $C_{TOLERANCE}$ can facilitate a low assembled concentricity (e.g., 0.5%) of the abrasive assembly 2.

The abrasive disc 6 can be formed from any known construction and comprise any type of abrasive disc (e.g., bonded, coated, woven, etc.). In a non-limiting embodiment, the abrasive disc 6 can comprise a non-woven abrasive comprising a non-woven web of fibrous material. The non-woven web can comprise a single or multiple layers of non-woven material bonded together to form a non-woven disc.

The non-woven web can contain abrasive particles, which are bound to the non-woven web. In a certain embodiment, the abrasive particles can be distributed homogenously in the non-woven web. In another embodiment, the abrasive particles can be applied to selective portions of the abrasive disc (i.e., a single layer of abrasive material can be disposed on the surface of the non-woven web). For example, the abrasive particles can be located in an abrasive sheet affixed to the abrasive disc 6. Alternatively, the abrasive particles can be applied to the abrasive disc 6 by spraying or an adhesive. In such a manner, there can be a higher concentration of abrasive particles in particular regions (e.g., along a working surface) of the abrasive disc 6.

In a particular aspect, the abrasive particles can have an average grain size ranging from about 24 grit to about 1000 grit according to the U.S. Coated Abrasive Manufacturers Institute ("CAMI") grading system. In another embodiment, the abrasive particles can have an average grain size from about 30 grit to about 120 grit. In yet another embodiment, the abrasive particles can have an average grain size from about 36 grit to about 100 grit.

In another aspect, the abrasive particles have an average grain size of at least about 93 microns, at least about 116 microns, or at least about 141 microns. In yet another embodiment, the abrasive particles have an average grain size not greater than about 715 microns, not greater than about 745 microns, or not greater than about 764 microns. The abrasive particles can have a Mohs hardness of at least about 8.0, such as at least about 8.5, or even at least about 9.0.

In one embodiment, the abrasive particles can be surface treated. In one embodiment, the abrasive particles can be silylated. In another embodiment, the surface treatment can be done by a coupling agent. The coupling agent can be a silane containing coupling agent selected from an aminoalkylsilane, an isocyanatosilane, a chloroalkysilane, or any combination thereof.

In a certain aspect, the abrasive assembly can be adapted to utilize one of a plurality of abrasive discs. Each abrasive disc of the plurality of abrasive discs can have a different abrasive particle configuration (i.e., a different grit, or a different average grain size), or can have a different size or feature. An operator or machinist can choose a single abrasive disc from among the plurality of abrasive discs to select the proper abrasive disc for the proposed application. In this regard, the operator can use a single back-up pad of the abrasive assembly for several different purposes (e.g., abrading, polishing, etc.). Moreover, the operator can select and change between abrasive discs in a minimal amount of time (e.g., in less than about 5 seconds, such as in less than about 4 seconds, or even in less than about 3 seconds).

In particular embodiments, the abrasive disc 6 can be relatively elastic. In this regard, the abrasive disc 6 can be easily bent and deformed under loading conditions. In certain embodiments, the abrasive disc 6 can have an average Modulus of Elasticity, as measured by an average Modulus of Elasticity of the body thereof, of less than about 0.5 gigaPascals (GPa), such as less than about 0.25 GPa, less than about 0.1 GPa, less than about 0.01 GPa, or even less than about 0.001 GPa.

Referring to FIGS. 1A, 1B, and 2, in particular embodiments, the abrasive disc 6 can comprise a central axis 8, a first surface 10, and a second surface 12 opposite the first surface 10. The abrasive disc 6 can have a thickness, $T_D$, as measured by a distance between the first and second surfaces 10 and 12 extending in a direction parallel to the central axis 8 of the abrasive disc 6.

The abrasive disc 6 can further include an engagement component 14 and an alignment element 16. The engagement component 14 and the alignment element 16 can be selected to engage with and complement an engagement component 62 and an alignment element (shown in FIGS. 4 and 5 as element 64) of the back-up pad 50. In this regard, the abrasive disc 6 and the back-up pad 50 can be attached to form an abrasive assembly 2, as described in greater detail below. In such a manner, complementary alignment elements 16 and 64 can act to enhance concentricity of the abrasive assembly 2.

As contemplated herein, the engagement component 14 of the abrasive disc 6 can comprise any engagement component adapted to form a connection with a complementary engagement component positioned on the back-up pad 50. In particular, the engagement component 14 of the abrasive disc 6 can comprise a quick-release system, such as, for example, a layer of fastening material such as a hook-and-loop engagement structure like that marketed under the brand name VELCRO®, by Velcro U.S.A.

In other embodiments, the engagement component 14 may comprise any other known removable engagement structure, such as, for example, a layer of adhesive disposed at least partially over the first surface 10 of the abrasive disc 6. The layer of adhesive can comprise any known adhesive exhibiting temporary adhesion characteristics. In a particular embodiment, the layer of adhesive can comprise a tacky adhesive like that marketed under the brand name Mounting Spray®, by Elmer's Products.

In particular embodiments, the engagement component 14 can be disposed at least partially along the first surface 10 of the abrasive disc 6. In such embodiments, the engagement component 16 can be disposed on at least 5% of the first surface 10, such as at least 10% of the first surface 10, at least 25% of the first surface 10, at least 50% of the first surface 10, or even at least 75% of the first surface 10. In further embodiments, the engagement component 16 can be disposed substantially along the first surface 10 of the abrasive disc 6. In yet other embodiments, the engagement component 16 can be disposed along the entire first surface 10 of the abrasive disc 6.

Figure 4:
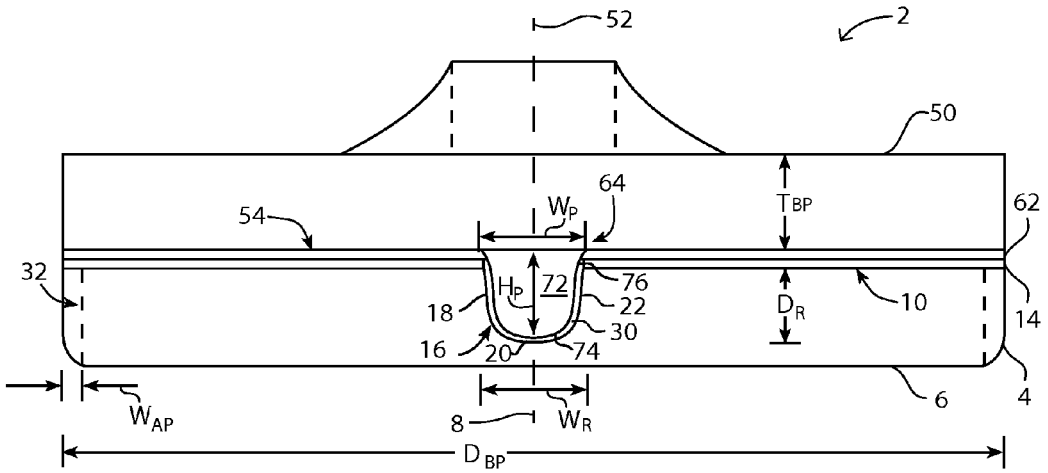
FIG. 4 includes a cross-sectional side view of an abrasive assembly as taken along Line A-A of FIG. 3A.
Figure 5:
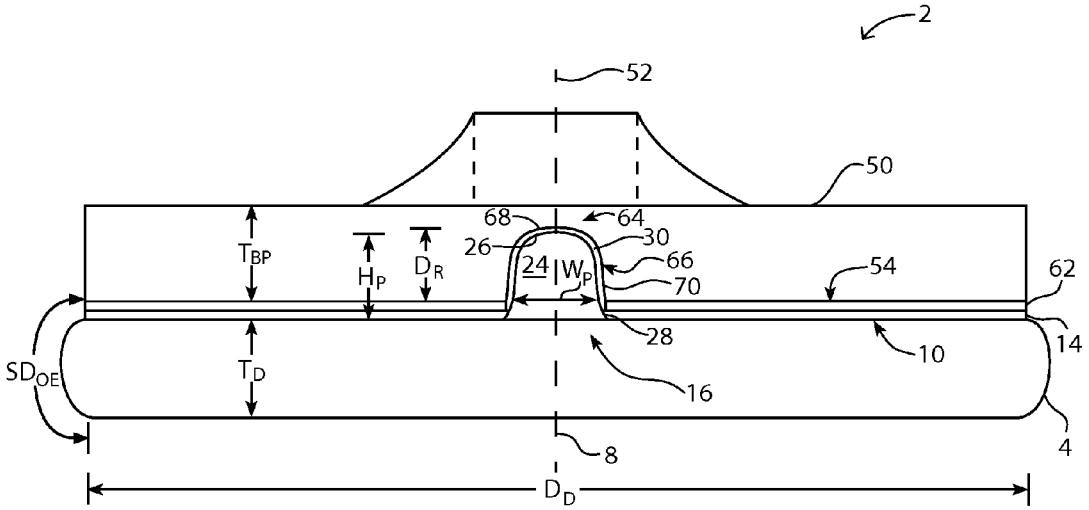
FIG. 5 includes a cross-sectional side view of an abrasive assembly as taken along Line A-A of FIG. 3A.

Referring to FIGS. 4 and 5, the alignment element 16 of the abrasive disc 6 can comprise one of a recess 18 (e.g., shown in FIG. 4) or a projection 24 (e.g., shown in FIG. 5) extending from the first surface 10 in a direction generally parallel with the central axis 8 of the abrasive disc 6. The alignment element 16 of the abrasive disc 6 can be substantially complementary to the alignment element 64 of the back-up pad 50. In this regard, the alignment elements 16 and 64 can substantially mitigate misalignment between the back-up pad 50 and the abrasive disc 6 during assembly.

As shown in FIG. 4, in certain embodiments, the recess 18 can extend at least partially into the abrasive disc 6. In this regard, the recess 18 can extend into the abrasive disc a depth, $D_R$, as measured by a maximum distance the recess 18 extends from the first surface 10 of the abrasive disc 6. In particular embodiments, $D_R/T_D$ can be no greater than about 1.0, such as less than about 0.95, less than about 0.90, less than about 0.85, less than about 0.80, less than about 0.75, less than about 0.70, less than about 0.65, less than about 0.60, less than about 0.55, or even less than about 0.50. In further embodiments, $D_R/T_D$ can be no less than about 0.10, such as no less than about 0.25, no less than about 0.30, no less than about 0.40, or even no less than about 0.50. Moreover, the value of $D_R/T_D$ can be within a range between and including any of the values described above, such as, for example, between about 0.30 and 0.60.

In particular embodiments, the recess 18 can have a generally frustoconical shape and can define a generally frustoconical cavity within the abrasive disc 6. In other embodiments, the recess 18 can have other geometric shapes, such as, for example, one or more of a circular, hemispherical, or polygonal shape.

Moreover, in certain embodiments, the recess 18 can have a generally rounded apex 20.

The recess 18 can have a maximum width, $W_R$, as measured in a direction parallel with and coplanar to the first surface 10 of the abrasive disc 6. In particular embodiments $D_R/W_R$ can be no less than about 0.2, no less than about 0.5, no less than about 0.75, no less than about 1.0, no less than about 1.25, no less than about 1.5, or even no less than about 1.75. In further embodiments, $D_R/W_R$ can be no greater than about 2.5, such as no greater than about 2.0, no greater than about 1.75, no greater than about 1.5, no greater than about 1.25, no greater than about 1.0, no greater than about 0.75, or even no greater than about 0.50. Moreover, $D_R/W_R$ can be within a range between and including any of the values described above.

In a particular aspect, the recess 18 can have a non-parallel sidewall 22. In other words, the sidewall 22 of the recess 18 can be non-cylindrical. In such a manner, the recess 18 can be wider (i.e., have a wider diameter) at a location closer to the first surface 10 of the abrasive disc 6 than at the apex 20. This can enable quicker and easier assembly of the abrasive disc 6 with the back-up pad 50 (i.e., a projection 72 of the back-up pad 50 can more easily align with the recess 18 of the abrasive disc 6) as compared to alternative embodiments wherein the recess 18 comprises a cylindrical, or generally cylindrical, sidewall 22. A tapered recess 18 can permit easier alignment while simultaneously maintaining a low assembled concentricity.

As shown in FIG. 5, in other embodiments, a projection 24 can extend outward from the first surface 10 of the abrasive disc 6 in a direction substantially parallel with the central axis 8 of the abrasive disc 6. In this regard, the projection 24 can extend from the first surface 10 of the abrasive disc 6 a height, $H_P$, as measured by a maximum distance the projection 24 extends from the first surface 10 thereof.

In particular embodiments, $H_P/T_D$ can be less than about 2.0, such as less than about 0.95, less than about 0.90, less than about 0.85, less than about 0.80, less than about 0.75, less than about 0.70, less than about 0.65, less than about 0.60, less than about 0.55, or even less than about 0.50. In further embodiments, $H_P/T_D$ can be no less than about 0.10, such as no less than about 0.25, no less than about 0.30, no less than about 0.40, or even no less than about 0.50. Moreover, the value of $H_P/T_D$ can be within a range between and including any of the values described above, such as, for example, between about 0.30 and 0.60.

In particular embodiments, the projection 24 can have a generally frustoconical shape. In other embodiments, the projection 24 can have another geometric shape, such as, for example, one or more of a circular, hemispherical, or polygonal shape.

Moreover, in certain embodiments, the projection 24 can have a generally rounded apex 26.

The projection 24 can have a maximum width, $W_P$, as measured parallel with and coplanar to the first surface 10, such that $H_P/W_P$ is no less than about 0.2, no less than about 0.5, no less than about 0.75, no less than about 1.0, no less than about 1.25, no less than about 1.5, or even no less than about 1.75. In further embodiments, $H_P/W_P$ can be no greater than about 2.5, such as no greater than about 2.0, no greater than about 1.75, no greater than about 1.5, no greater than about 1.25, no greater than about 1.0, no greater than about 0.75, or even no greater than about 0.50. Moreover, $H_P/W_P$ can be within a range between and including any of the values described above.

The maximum width, $W_P$, of the projection 24 can be substantially less than a diameter, $D_D$, of the abrasive disc 6. In particular embodiments, $D_D/W_P$ can be at least about 10.0, such as at least about 15.0, at least about 20.0, at least about 25.0, at least about 30.0, at least about 40.0, at least about 50.0, or even at least about 75.0. In yet further embodiments, $D_D/W_P$ can be no greater than about 500, such as no greater than about 400, no greater than about 300 no greater than about 200, or even no greater than about 100. Moreover, $D_D/W_P$ can be within a range between and including any of the values described above.

In a particular aspect, the projection 24 can have a non-parallel sidewall 28. In other words, the sidewall 28 of the projection 24 can be non-cylindrical. In such a manner, the projection 24 can be wider (i.e., have a wider diameter) closer to the first surface 10 of the abrasive disc 6 than at the apex 26. This can enable quicker and easier assembly of the abrasive disc 6 with the back-up pad 50 (i.e., the projection 24 of the abrasive disc 6 can more easily align with the recess 66 of the back-up pad 50) as compared to alternative embodiments wherein the projection 24 comprises a cylindrical, or generally cylindrical, sidewall 28.

In particular embodiments, the alignment element 16 of the abrasive disc 6 can be positioned adjacent to the first surface 10 thereof. Specifically, the alignment element 16 can be disposed on the first surface 10 of the abrasive disc 6. In this regard, the alignment element 16 can be attached directly to the first surface 10 of the abrasive disc 6. The alignment element 16 can be attached to the abrasive disc 6 by any method known in the art for joining objects, such as, for example, by an adhesive, a weld (e.g., spin welding or friction welding), a threaded or non-threaded fastener, or any combination thereof.

In other embodiments (not shown), the alignment element can be attached to the abrasive disc by way of (i.e., indirectly through) the engagement component. In this regard, the alignment element can be attached indirectly to the first surface of the abrasive disc. Similar to the embodiment described above, the alignment element can be attached to the engagement component by any method known in the art for joining objects, such as, for example, adhesive, welding (e.g., spin welding or friction welding), threaded or non-threaded fasteners, or any combination thereof.

Referring still to FIGS. 4 and 5, in particular embodiments, the abrasive disc 6 can have a generally rectilinear cross section when viewed in a direction perpendicular to a plane formed between the first and second surfaces 10 and 12. In this regard, the first surface 10 can be parallel, or substantially parallel, with the second surface 12. In a further embodiment, the first and second surfaces 10 and 12 can be generally flat as seen in a cross-section between diametrically opposite locations.

With the exception of the alignment element 16, in a preferred embodiment, the abrasive disc 6 can be free, or substantially free, of any lips, radial projections, notches, flanges, or axial components extending from the first and/or second surfaces 10 and 12.

The outer edge 4 of the abrasive disc 6 can have a substantially uniform cross-sectional shape around the circumference of the abrasive disc 6. In a non-limiting embodiment, as shown in FIG. 4, the outer edge 4 of the abrasive disc 6 can have a linear, or substantially linear, edge profile extending between the first surface 10 and the second surface 12. Moreover, in certain embodiments, the outer edge 4 can be perpendicular to the first and second surfaces 10 and 12.

In another embodiment, as shown in FIG. 5, the outer edge 4 can have an arcuate profile, or an arcuate portion, extending between the first surface 10 and the second surface 12. In such a manner, the outer edge 4 can be shaped to have a concave and/or convex portion. In yet another embodiment, the outer edge 4 can comprise another geometric cross-sectional shape (e.g., triangular, pentagonal, ellipsoidal, etc.) consistent with edge grinding abrasive techniques readily understood in the art.

Referring again to FIG. 1A, the outer edge 4 can have an exposed height, $H_{OE}$, as measured by a distance the outer edge 4 extends along the thickness of the abrasive disc. In a particular embodiment, $H_{OE}$, can be no greater than about 1.0 $T_D$, such as no greater than about 0.9 $T_D$, no greater than about 0.8 $T_D$, no greater than about 0.7 $T_D$, no greater than about 0.6 $T_D$, or even no greater than about 0.5 $T_D$. In certain embodiments, $H_{OE}$ can be no less than about 0.05 $T_D$, such as no less than about 0.1 $T_D$, no less than about 0.2 $T_D$, no less than about 0.3 $T_D$, or even no less than about 0.4 $T_D$. Moreover, $H_{OE}$ can be within a range between and including any of the values described above, such as, for example, between about 0.85 $T_D$ and about 0.95 $T_D$.

In certain embodiments, the outer edge 4 of the abrasive disc 6 can have a higher concentration of abrasive particles than the average particle concentration of the overall abrasive disc 6. For example, the abrasive disc 6 can have an average particle concentration, $PC_A$, whereas the outer edge 4 can have a particle concentration, $PC_{OE}$, where $PC_{OE}$ is at least 1.5 $PC_A$, such as at least 2.0 $PC_A$, at least 2.5 $PC_A$, or even at least 3.0 $PC_A$. In other embodiments, the outer edge 4 can have an equal particle concentration, $PC_{OE}$, as compared to the average particle concentration, $PC_A$, of the abrasive disc 6.

In particular embodiments, as seen in FIG. 4, the abrasive disc 6 can further include an outer abrasive portion 32 extending radially inward from the outer edge 4 towards the central axis 8. The outer abrasive portion 32 can have a higher concentration of abrasive particles, $PC_{AP}$, than the average particle concentration, $PC_A$, of the overall abrasive disc 6. For example, $PC_{AP}$ can be at least 1.5 $PC_A$, such as at least 2.0 $PC_A$, at least 2.5 $PC_A$, at least 3.0 $PC_A$, at least 3.5 $PC_A$, or even at least 4.0 $PC_A$. Thus, in applications requiring prolonged edge grinding, the abrasive characteristics of the outer abrasive portion 32 of the abrasive disc 6 can remain more uniform irrespective of wear characteristics and abrasive particle fatigue.

The outer abrasive portion 32 can comprise an annular volume having a radial width, $W_{AP}$, as measured from the furthest radial position of the outer edge 4 radially inward toward the central axis 8. In certain embodiments $D_D/W_{AP}$ can be no less than about 3.0, such as no less than about 4.0, no less than about 5.0, no less than about 10.0, no less than about 20.0, no less than about 50.0, or even no less than about 100.0.

In certain embodiments, the outer abrasive portion 32 can extend along the entire thickness, $T_D$, of the abrasive disc 6.

Figure 9:
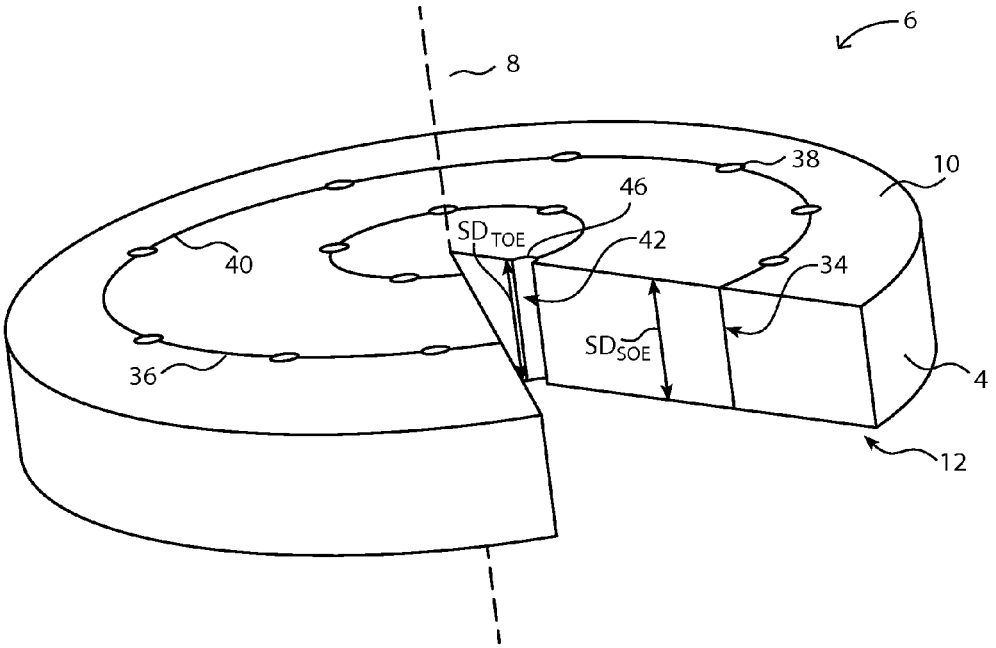
FIG. 9 includes a partially removed perspective view of an abrasive disc in accordance with an embodiment.
Figure 10:
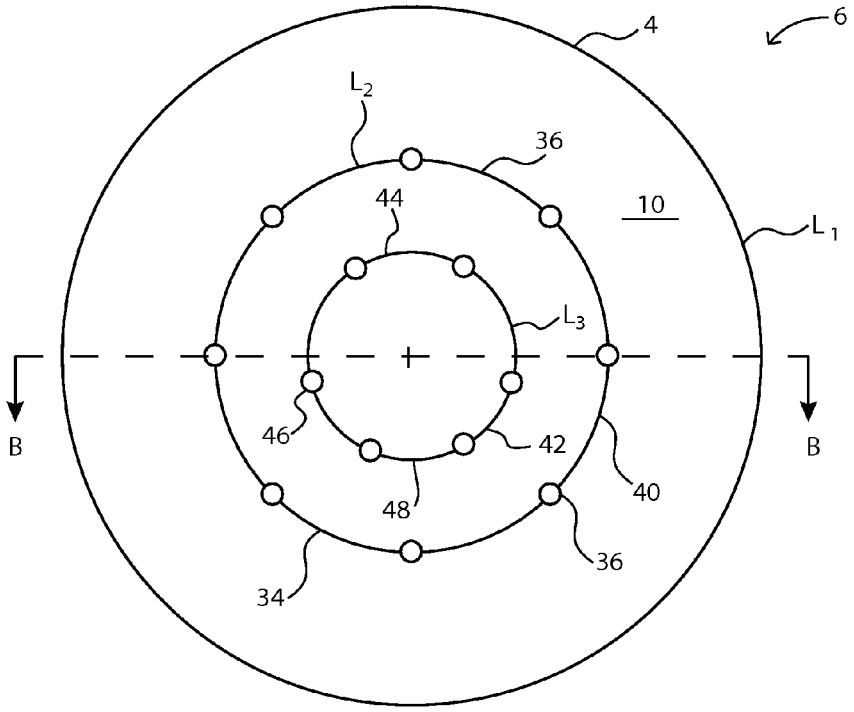
FIG. 10 includes a top view of an abrasive disc in accordance with an embodiment.

As contemplated herein, and as shown in FIGS. 9 and 10, in certain embodiments the abrasive disc 6 can further comprise a secondary outer edge 34 disposed within the abrasive disc 6. The secondary outer edge 34 can be substantially coaxial with the central axis 8 of the abrasive disc 6 and can extend between the first and second surfaces 10 and 12. The secondary outer edge 34 can have a circumferential length, $L_2$, as seen from the second surface 10, less than a circumferential length, $L_1$ of the outer edge 4.

The secondary outer edge 34 can have any number of similar characteristics as compared to the outer edge 4, such as, for example, a similar particle concentration, a similar height, a similar radial width, or any combination of the aforementioned features.

In a non-limiting embodiment, the secondary outer edge 34 of the abrasive disc 6 can have a linear edge profile extending between the first surface 10 and the second surface 12. Moreover, in certain embodiments, the secondary outer edge 34 can be perpendicular to the first and second surfaces 10 and 12. In another embodiment, the secondary outer edge 34 can have an arcuate profile, or an arcuate portion, extending between the first surface 10 and the second surface 12. In such a manner, the secondary outer edge 34 can be shaped to have a concave and/or convex portion. In yet another embodiment, the second outer edge 34 can comprise another geometric cross-sectional shape (e.g., triangular, pentagonal, ellipsoidal, etc.) consistent with edge grinding abrasive techniques readily understood in the art.

While the outer edge 4 remains attached to the abrasive disc 6, the secondary outer edge 34 can be notional (i.e., it is at least partially hidden and not fully exposed for work piece abrading and manipulation). In this regard, the outer edge 4 of the abrasive disc 6 can be used to affect a desirable surface finish on a work piece while the secondary outer edge 34 is unaffected and remains intact.

In certain embodiments, a structurally weakened portion 36 can be positioned immediately adjacent to, or along, the secondary outer edge 34. The structurally weakened portion 36 can be shaped and sized to permit the abrasive disc 6 to break along a predefined path immediately adjacent to, or along, the secondary outer edge 34. This can allow an operator to operate with the outer edge 4 of the abrasive disc 6 until the surface treatment performance thereof is diminished, at which time the operator can remove the outermost portion of the abrasive disc 6 to reveal an unused, or substantially unused, secondary outer edge 34 to affect surface treatment of the work piece.

While the structurally weakened portion 36 is intact, the secondary outer edge 34 remains notional. Rupture of the structurally weakened portion 36 can reveal the secondary outer edge 34 for surface abrading and manipulation. The structurally weakened portion 36 can be substantially, or fully, coaxial with the central axis 8 of the abrasive disc 6.

Figure 11A:
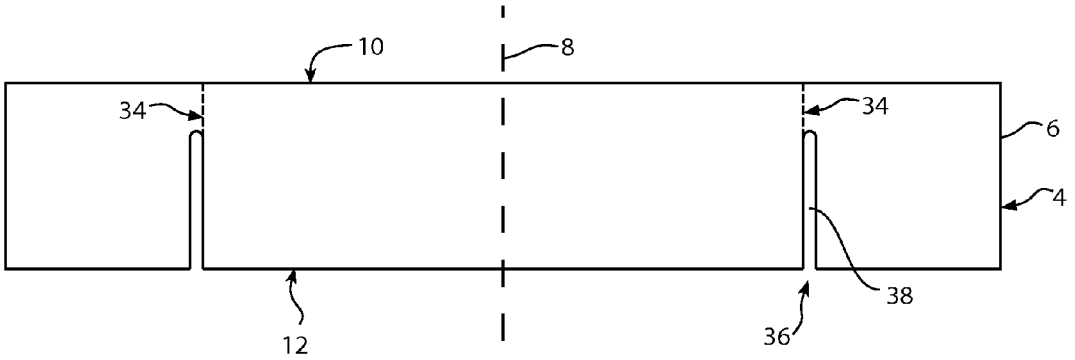
FIG. 11A includes a cross-sectional side view of an abrasive disc in accordance with an embodiment as seen along Line B-B of FIG. 10.
Figure 11B:
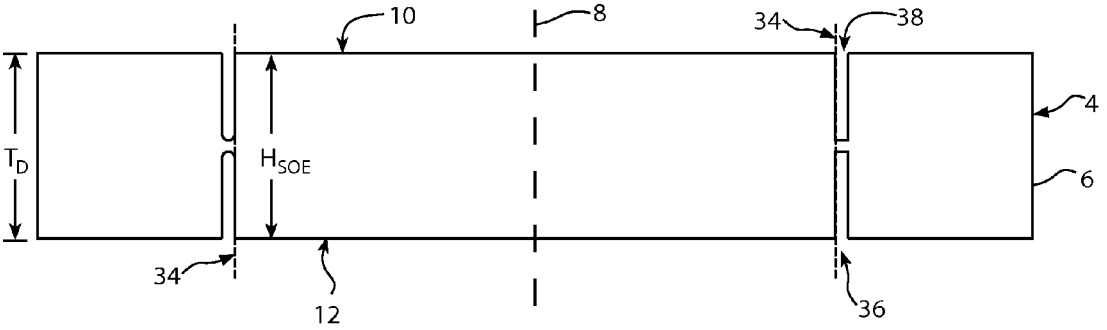
FIG. 11B includes a cross-sectional side view of an abrasive disc in accordance with an embodiment as seen along Line B-B of FIG. 10.
Figure 11C:
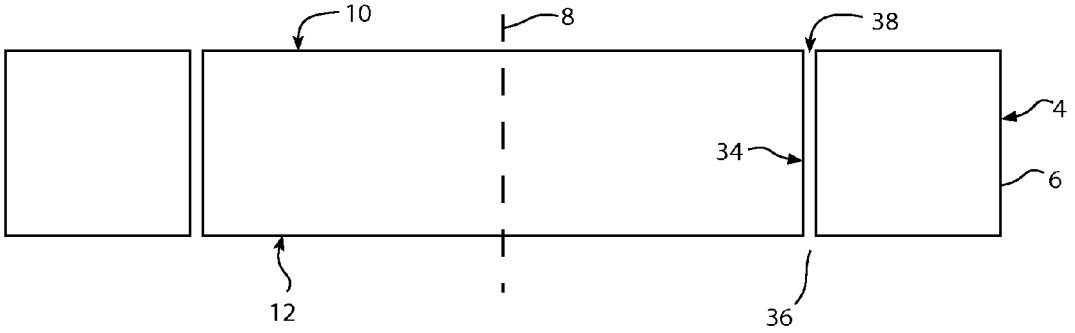
FIG. 11C includes a cross-sectional side view of an abrasive disc in accordance with an embodiment as seen along Line B-B of FIG. 10.

Referring now to FIGS. 11A, 11B, and 11C, in certain embodiments, the structurally weakened portion 36 can comprise a perforation 38 or groove extending at least partially through the abrasive disc 6 from one of the first or second surfaces 10 and 12, in a direction generally parallel to the central axis 8. In other embodiments, the structurally weakened portion 36 can comprise a perforation 38 or groove extending at least partially through the abrasive disc 6 from both the first and second surfaces 10 and 12, in a direction generally parallel to the central axis 8.

In other embodiments, as shown in FIG. 9, the structurally weakened portion 36 can comprise a plurality of perforations 38. In this regard, the structurally weakened portion 36 may contain at least about 5 perforations, at least about 10 perforations, at least about 15 perforations, at least about 20 perforations, at least about 50 perforations, at least about 75 perforations, at least about 100 perforations, at least about 150 perforations, at least about 250 perforations, or even at least about 500 perforations. In a further aspect, the structurally weakened portion 36 may contain no more than 5,000 perforations, such as no more than 4,000 perforations, no more than 3,000 perforations, no more than 2,000 perforations, no more than 1,000 perforations, or even no more than about 750 perforations. Moreover, the number of perforations contained within the structurally weakened portion can be within a range between and including any of the values described above, such as, for example, between about 75 perforations and about 110 perforations.

In a particular aspect, the perforations 38 can be formed during shaping of the abrasive disc 6 (e.g., molded). In another aspect, after the abrasive disc 6 has been shaped, the perforations 38 can be impregnated, for example, by pressing, rolling, stamping, punching, drilling, cutting, or any combination thereof. Moreover, in a certain aspect, any combination of perforations 38 can be formed using different techniques.

In certain embodiments, the perforations 38 can have different sizes and shapes relative to each other, and can extend into the abrasive disc 6 at different angles relative to one another and to different relative depths.

Referring again to FIGS. 11A, 11B, and 11C, each perforation 38 can extend from one of the first and second surfaces 10 and 12 of the abrasive disc 6 towards the other one of the first and second surfaces 10 and 12. In a particular aspect, at least one of the perforations 38 can extend fully between the first and second surfaces 10 and 12. In a more particular aspect, a plurality of perforations can extend fully between the first and second surfaces 10 and 12. In yet a more particular aspect, each perforation 38 of the plurality of perforations can extend fully between the first and second surfaces 10 and 12.

The perforations 38 can extend along a similar plane (i.e., parallel with the central axis 8 of the abrasive disc 6) or extend in a non-parallel fashion (i.e., non-parallel with the central axis 8 of the abrasive disc 6).

Referring again to FIGS. 9 and 10, in particular embodiments, the structurally weakened portion 36 can further comprise a shedable portion 40. The shedable portion 40 may include an element adapted to rupture the structurally weakened portion 36. In this regard, the shedable portion 40 may include a tab, interconnect, string, band, fastener, or any combination thereof which permits an operator to rupture the structurally weakened portion 36 more easily. The shedable portion 40 can be positioned within, between, around, adjacent to, or even integrally formed into the structurally weakened portion 36.

In particular embodiments, the structurally weakened portion 36 can be adapted to remain intact upon an application of a torque to the abrasive disc 6 in a direction around the central axis 8 thereof. The structurally weakened portion 36 can be adapted to withstand (i.e., remain intact) a torque of at least about 5 Nm, such as at least about 10 Nm, at least about 50 Nm, at least about 100 Nm, or even at least about 500 Nm. The structurally weakened portion can also be configured to remain intact upon application of a torque around the central axis 8 of the abrasive disc 6 of no greater than about 10,000 Nm, such as no greater than about 5,000 Nm, no greater than about 2,500 Nm, no greater than about 1,000 Nm, or even no greater than about 500 Nm. Moreover, the force required to rupture the structurally weakened portion 36 can be within a range between and including any of the values described above.

Referring again to FIGS. 11A, 11B, and 11C, the secondary outer edge 34 can have an exposed height, $H_{SOE}$, as measured by a distance the secondary outer edge 34 extends along the thickness of the abrasive disc 6 and radially along the first and second surfaces 10 and 12 of the abrasive disc. In a particular embodiment, $H_{SOE}$, can be no greater than about 1.0 $T_D$, such as no greater than about 0.9 $T_D$, no greater than about 0.8 $T_D$, no greater than about 0.7 $T_D$, no greater than about 0.6 $T_D$, or even no greater than about 0.5 $T_D$. In certain embodiments, $H_{SOE}$ can be no less than about 0.05 $T_D$, such as no less than about 0.1 $T_D$, no less than about 0.2 $T_D$, no less than about 0.3 $T_D$, or even no less than about 0.4 $T_D$. Moreover, $H_{SOE}$ can be within a range between and including any of the values described above, such as, for example, between about 0.85 $T_D$ and about 0.95 $T_D$.

Referring again to FIGS. 9 and 10, in yet a further embodiment, the abrasive disc 6 can include a tertiary outer edge 42. The tertiary outer edge 42 can be substantially coaxial with the central axis 8 of the abrasive disc 6 and can extend between the first and second surfaces 10 and 12 of the abrasive disc 6. The tertiary outer edge 42 can have a circumferential length, $L_3$, that is less than the circumferential length, $L_2$ of the secondary outer edge 34.

In a non-limiting embodiment, the tertiary outer edge 42 of the abrasive disc 6 can have a linear thickness profile extending between the first surface 10 and the second surface 12. Moreover, in certain embodiments, the tertiary outer edge 42 can be perpendicular to the first and second surfaces 10 and 12. In another embodiment, the tertiary outer edge 42 can have an arcuate profile, or an arcuate portion, extending between the first surface 10 and the second surface 12. In such a manner, the tertiary outer edge 42 can be shaped to have a concave and/or convex portion. In yet another embodiment, the tertiary outer edge 42 can comprise another geometric cross-sectional shape (e.g., triangular, pentagonal, ellipsoidal, etc.) consistent with edge grinding abrasive techniques readily understood in the art.

While the second outer edge 34 remains attached to the abrasive disc 6, the tertiary outer edge 42 can be notional (i.e., it is at least partially hidden and not fully exposed for work piece abrading and manipulation). In this regard, the secondary outer edge 34 of the abrasive disc 6 can be used to affect a desirable surface finish on a work piece while the tertiary edge 42 is unaffected and remains intact. A structurally weakened portion 44 can extend around the abrasive disc 6 adjacent the tertiary outer edge 42. While the structurally weakened portion 44 is intact (i.e., the secondary outer edge 34 is used for surface finishing) the tertiary outer edge 42 can remain notional.

Rupture of the structurally weakened portion 44 can reveal the tertiary outer edge 42, thereby exposing a tertiary abrasive radial surface.

The structurally weakened portion 44 can be substantially, or fully, coaxial with the central axis 8 of the abrasive disc 6.

In certain embodiments, the structurally weakened portion 44 can comprise a perforation 46 or groove extending at least partially through the abrasive disc 6 from one of the first and second surfaces 10 and 12 in a direction generally parallel to the central axis 8. In other embodiments, the structurally weakened portion 44 can comprise a plurality of perforations 46. In this regard, the structurally weakened portion 44 may contain at least about 5 perforations, at least about 10 perforations, at least about 15 perforations, at least about 20 perforations, at least about 50 perforations, at least about 75 perforations, at least about 100 perforations, at least about 150 perforations, at least about 250 perforations, or even at least about 500 perforations. In a further aspect, the structurally weakened portion 44 may contain no more than 5,000 perforations, such as no more than 4,000 perforations, no more than 3,000 perforations, no more than 2,000 perforations, no more than 1,000 perforations, or even no more than about 750 perforations. Moreover, the number of perforations 46 contained within the structurally weakened portion can be within a range between and including any of the values described above, such as, for example, between about 75 perforations and about 110 perforations.

In a particular aspect, similar to the perorations 38 adjacent the secondary outer edge 34, the perforations 46 adjacent to the tertiary outer edge 42 can be formed during shaping of the abrasive disc 6 (e.g., molded). In another aspect, after the abrasive disc 6 has been shaped, the perforations can be impregnated, for example, by pressing, rolling, stamping, punching, drilling, or any combination thereof. Moreover, in a certain aspect, any combination of perforations 46 can be formed using different techniques. The perforations 46 can have different sizes and shapes relative to each other, and can extend into the abrasive disc 6 at different angles and to different depths.

Each perforation 46 can extend from one of the first and second surfaces 10 and 12 of the abrasive disc 6 towards the other one of the first and second surfaces 10 and 12. In a particular aspect, at least one of the perforations 46 can extend fully between the first and second surfaces 10 and 12. In a more particular aspect, a plurality of perforations 46 can extend fully between the first and second surfaces 10 and 12. In yet a more particular aspect, each perforation 46 can extend fully between the first and second surfaces 10 and 12.

The perforations 46 can extend along a similar plane (i.e., parallel with the central axis 8 of the abrasive disc 6) or extend in a non-parallel fashion (i.e., non-parallel with the central axis 8 of the abrasive disc 6).

In particular embodiments, the structurally weakened portion 44 can further comprise a shedable portion 48. The shedable portion 48 may include an element adapted to rupture the structurally weakened portion 44. In this regard, the shedable portion 48 may include a tab, interconnect, string, band, fastener, or any combination thereof which permits an operator to rupture the structurally weakened portion 44 more easily. The shedable portion 48 can be positioned within, between, around, adjacent to, or even integrally formed into the structurally weakened portion 44.

In particular embodiments, the structurally weakened portion 44 can be adapted to remain intact upon an application of a torque to the abrasive disc 6 in a direction around the central axis 8 thereof. The structurally weakened portion 44 can be adapted to withstand (i.e., remain intact) a torque of at least about 5 Nm, such as at least about 10 Nm, at least about 50 Nm, at least about 100 Nm, or even at least about 500 Nm. The structurally weakened portion can also be configured to remain intact upon application of a torque around the central axis 8 of the abrasive disc 6 of no greater than about 10,000 Nm, such as no greater than about 5,000 Nm, no greater than about 2,500 Nm, no greater than about 1,000 Nm, or even no greater than about 500 Nm. Moreover, the force required to rupture the structurally weakened portion 44 can be within a range between and including any of the values described above.

The tertiary outer edge 42 can have an exposed height, $H_{TOE}$, as measured by a distance the tertiary outer edge 42 extends along the thickness of the abrasive disc 6 and radially along the first and second surfaces 10 and 12 of the abrasive disc 6. In a particular embodiment, $H_{TOE}$, can be no greater than about 1.0 $T_D$, such as no greater than about 0.9 $T_D$, no greater than about 0.8 $T_D$, no greater than about 0.7 $T_D$, no greater than about 0.6 $T_D$, or even no greater than about 0.5 $T_D$. In certain embodiments, $H_{TOE}$ can be no less than about 0.05 $T_D$, such as no less than about 0.1 $T_D$, no less than about 0.2 $T_D$, no less than about 0.3 $T_D$, or even no less than about 0.4 $T_D$. Moreover, $H_{TOE}$ can be within a range between and including any of the values described above, such as, for example, between about 0.85 $T_D$ and about 0.95 $T_D$.

Back-Up Pad

Referring again to FIGS. 1A and 1B, in particular embodiments, the back-up pad 50 can comprise a central axis 52, a first surface 54, and a second surface 56 opposite the first surface 54. The back-up pad 50 can have a thickness, $T_{BP}$, as measured by a distance between the first surface 54 and the second surface 56 extending in a direction parallel to the central axis 52 of the back-up pad 50.

In certain embodiments, $T_{BP}$ can be equal to the thickness, $T_D$, of the abrasive disc 6. In alternate embodiments, $T_D$ can be at least about 0.1 $T_{BP}$, such as at least about 0.25 $T_{BP}$, at least about 0.75 $T_{BP}$, at least about 1.0 $T_{BP}$, at least about 1.25 $T_{BP}$, at least about 1.50 $T_{BP}$, or even at least about 2.0 $T_{BP}$. In yet other embodiments, $T_{BP}$ can be at least about 1.05 $T_D$, such as at least about 1.10 $T_D$, at least about 1.25 $T_D$, at least about 1.50 $T_D$, or even at least about 2.0 $T_D$.

In certain embodiments, the back-up pad 50 can have a non-rectilinear cross section when viewed in a plane extending radially from the central axis 52. In this regard, the first and second surfaces 54 and 56 can have a relative angular offset therebetween. For example, in particular embodiments, the back-up pad 50 can comprise a generally frustoconical shape, a hemispherical shape, a generally pyramidal shape, or any combination thereof.

In particular embodiments, the back-up pad 50 can further include a hub 58 centered along and extending from the second surface 56. The hub 58 can be engaged to the back-up pad 50 by an adhesive, a weld, a fastener (threaded or non-threaded), or any combination thereof. The hub 58 can have at least one of several geometrical shapes, such as, for example, a rectilinear shape, an ellipsoidal shape, or a combination thereof. In a particular embodiment, the hub 58 can be generally frustoconical and can define a central aperture extending in a direction perpendicular to the second surface 56 of the back-up pad 50.

A mandrel 60 can extend from the central aperture of the hub 58 in a direction perpendicular to the first surface 56. The mandrel 60 can engage with the back-up pad 50 within the central aperture of the hub 58 by threaded or non-threaded means, such as, for example, by a complementary threaded engagement, a complementary non-threaded engagement structure, an adhesive, a cotter, or any combination thereof. The mandrel 60 can extend from the back-up pad 50 and attach to a machine (not shown) allowing the abrasive assembly 2 to rotate about a central axis 52 (drive axis).

In certain embodiments, the back-up pad 50 can be relatively rigid so as to provide sufficient support to the abrasive disc 6. Preferably, the back-up pad 50 can comprise a plastic, such as, for example, acronitrile butadiene styrene (ABS).

In another embodiment, the back-up pad 50 can comprise a material having an average modulus of elasticity (MOE), as measured by an average value within the volume of the back-up pad 50, of no less than about 1.0 GigaPascals (GPa), such as no less than about 1.5 GPa, no less than 2.0 GPA, no less than 2.5 GPa, no less than about 5 GPa, or even no less than about 10 GPa. In yet further embodiments, the back-up pad 50 can comprise a material having an MOE of no greater than about 100 GPa, such as no greater than about 75 GPa, no greater than about 50 GPa, no greater than about 25 GPa, or even no greater than about 12 GPa. Moreover, the back-up pad can comprise a material having an MOE within a range between and including any of the values described above. In this regard, the abrasive assembly 2 (specifically, surfaces 12 and/or 4 the abrasive disc 6) can be urged against the surface of a work piece to affect a desired surface characteristic without significantly deforming or bending.

In further embodiments, the back-up pad can include an internal frame (not shown) to enhance structural rigidity.

The back-up pad 50 can further include an engagement component 62 and an alignment element (shown in FIGS. 4 and 5 as element 64).

As contemplated herein, the engagement component 62 of the back-up pad 50 can comprise any engagement structure adapted to form a connection with a complementary engagement structure positioned on the abrasive disc 6. In particular, the engagement component 62 of the back-up pad 50 can comprise a quick-release system, such as, for example, a layer of fastening material such as a hook-and-loop engagement structure like that marketed under the brand name VELCRO®, by Velcro U.S.A.

In other embodiments, the engagement component 62 can comprise any other known temporary engagement component, such as, for example, a layer of adhesive disposed at least partially over the first surface 54 of the back-up pad 50. The layer of adhesive can comprise any known adhesive exhibiting temporary adhesion characteristics. In a particular embodiment, the layer of adhesive can comprise a tacky adhesive like that marketed under the brand name Mounting Spray®, by Elmer's Products.

In particular embodiments, the engagement component 62 of the back-up pad 50 can be disposed at least partially along the first surface 54 of the back-up pad 50. In such embodiments, the engagement component 62 can be disposed on at least 5% of the first surface 54 of the back-up pad 50, such as at least 10% of the first surface 54, at least 25% of the first surface 54, at least 50% of the first surface 54, or even at least 75% of the first surface 54. In further embodiments, the engagement component 62 of the back-up pad 50 can be disposed substantially along the first surface 54 of the back-up pad 50. In yet other embodiments, the engagement component 62 of the back-up pad 50 can be disposed along the entire first surface 54 of the back-up pad 50.

The alignment element 64 of the back-up pad 50 can comprise any number of features similar and complementary to the alignment element 16 of the abrasive disc 6. For example, referring again to FIGS. 4 and 5, the alignment element 64 of the back-up pad 50 can comprise one of a recess 66 or a projection 72 extending from the first surface 54 in a direction generally parallel with the central axis 52 of the back-up pad 50.

As shown in FIG. 4, in accordance with an embodiment, the projection 72 can extend outward from the first surface 54 of the back-up pad 50 in a direction substantially parallel with the central axis 52 of the back-up pad 50. In this regard, the projection 72 can extend from the first surface 54 of the back-up pad 50 a height, $H_P$, as measured by a maximum distance the projection 72 extends from the first surface 54.

In particular embodiments, $H_P/T_{BP}$ can be equal to about 1.0. In other embodiments, $H_P/T_{BP}$ can be less than about 1.0, such as less than about 0.95, less than about 0.90, less than about 0.85, less than about 0.80, less than about 0.75, less than about 0.70, less than about 0.65, less than about 0.60, less than about 0.55, or even less than about 0.50. In further embodiments, $H_P/T_{BP}$ can be no less than about 0.10, such as no less than about 0.25, no less than about 0.30, no less than about 0.40, or even no less than about 0.50. Moreover, the value of $H_P/T_{BP}$ can be within a range between and including any of the values described above, such as, for example, between about 0.30 and 0.60.

In particular embodiments, the projection 72 can have a generally frustoconical shape. In other embodiments, the projection 72 can have another geometric shape, such as, for example, one or more of a circular, hemispherical, or polygonal shape.

Moreover, in particular embodiments, the projection 72 can have a generally rounded apex 74.

The projection 72 can have a maximum width, $W_P$, as measured in a direction parallel with and coplanar to the first surface 54, such that $H_P/W_P$ is no less than about 0.2, no less than about 0.5, no less than about 0.75, no less than about 1.0, no less than about 1.25, no less than about 1.5, or even no less than about 1.75. In further embodiments, $H_P/W_P$ can be no greater than about 2.5, such as no greater than about 2.0, no greater than about 1.75, no greater than about 1.5, no greater than about 1.25, no greater than about 1.0, no greater than about 0.75, or even no greater than about 0.50. Moreover, $H_P/W_P$ can be within a range between and including any of the values described above.

The maximum width, $W_P$, of the projection 72 can be substantially less than the diameter, $D_{BP}$, of the back-up pad 50. In particular embodiments, $D_{BP}/W_P$ can be at least about 10.0, such as at least about 15.0, at least about 20.0, at least about 25.0, at least about 30.0, at least about 40.0, at least about 50.0, or even at least about 75.0. In yet further embodiments, $D_{BP}/W_P$ can be no greater than about 500, such as no greater than about 400, no greater than about 300 no greater than about 200, or even no greater than about 100. Moreover, $D_{BP}/W_P$ can be within a range between and including any of the values described above.

In a particular aspect, the projection 72 can have a non-parallel sidewall 76. In other words, the sidewall 76 of the projection 72 can be non-cylindrical. In such a manner, the projection 72 can be wider (i.e., have a wider radius) closer to the first surface 54 of the back-up pad 50 than at the apex 74. This can allow for quicker and easier engagement of the projection 72 with the abrasive disc 6 as compared to alternative embodiments wherein the projection 72 comprises a cylindrical, or generally cylindrical, sidewall 76.

As shown in FIG. 5, in another embodiment, the alignment element 64 can comprise a recess 66 which can extend at least partially into the back-up pad 50. In this regard, the recess 66 can extend into the back-up pad a depth, $D_R$, as measured by a maximum distance the recess 66 extends from the first surface 54 of the back-up pad 50. In particular embodiments, $D_R/T_{BP}$ can be no greater than about 1.0, such as less than about 0.99, less than about 0.95, less than about 0.90, less than about 0.85, less than about 0.80, less than about 0.75, less than about 0.70, less than about 0.65, less than about 0.60, less than about 0.55, or even less than about 0.50. In further embodiments, $D_R/T_{BP}$ can be no less than about 0.10, such as no less than about 0.25, no less than about 0.30, no less than about 0.40, or even no less than about 0.50. Moreover, the value of $D_R/T_{BP}$ can be within a range between and including any of the values described above, such as, for example, between about 0.30 and 0.60.

In particular embodiments, the recess 66 can have a generally frustoconical shape defining a generally frustoconical cavity within the back-up pad 50. In other embodiments, the recess 66 can have another geometric shape, such as, for example, one or more of a circular, hemispherical, or polygonal shape.

Moreover, in particular embodiments, the recess 66 can have a generally rounded apex 68.

In embodiments where the recess 66 is circular, hemispherical, ellipsoidal, or has any rounded, or partially rounded portion or feature (e.g., a generally rounded apex), the rounded, or partially rounded portion, can have a radius of curvature within a range between and including about 0.01 inches and about 3.0 inches. More particularly, the radius of curvature of the rounded portion can be within a range between and including about 0.15 inches and about 0.9 inches. In yet a more particular embodiment, the radius of curvature of the rounded portion can be within a range between and including about 0.20 inches and about 0.75 inches.

The recess 66 can have a maximum width, $W_R$, as measured parallel with and coplanar to the first surface 54 of the back-up pad 50, such that $D_R/W_R$ is no less than about 0.2, no less than about 0.5, no less than about 0.75, no less than about 1.0, no less than about 1.25, no less than about 1.5, or even no less than about 1.75. In further embodiments, $D_R/W_R$ can be no greater than about 2.5, such as no greater than about 2.0, no greater than about 1.75, no greater than about 1.5, no greater than about 1.25, no greater than about 1.0, no greater than about 0.75, or even no greater than about 0.50. Moreover, $D_R/W_R$ can be within a range between and including any of the values described above.

In a particular aspect, the recess 66 can have a non-parallel sidewall 70. In other words, the sidewall 70 of the recess 66 can be non-cylindrical. In such a manner, the recess 66 can be wider (i.e., have a wider radius) closer to the first surface 54 of the back-up pad 50 than at the apex 68. The recess 66 can be stepped or comprise a number of segments having a relative angle therebetween. As will be discussed in more detail, a recess 66 with a non-parallel sidewall 70 can allow for a more rapid and easier engagement of the recess 66 with the abrasive disc 6 as compared to alternative embodiments wherein the recess 66 comprises a cylindrical, or generally cylindrical, sidewall 70.

In particular embodiments, the alignment element 64 of the back-up pad 50 can be positioned adjacent to the first surface 54 thereof. The alignment element 64 can be disposed on the first surface 54 of the back-up pad 50. In this regard, the alignment element 64 can be attached directly to the first surface 54 of the back-up pad 50. Alternatively, the alignment element 64 can be attached indirectly to the first surface 54 of the back-up pad 50 by way of the engagement component 62 or some other intermediate element. The alignment element 64 can be attached to the back-up pad 50 (directly or indirectly) by any method known in the art for joining objects, such as, for example, by an adhesive, a weld, a threaded or non-threaded fastener, or any combination thereof.

Figure 6A:
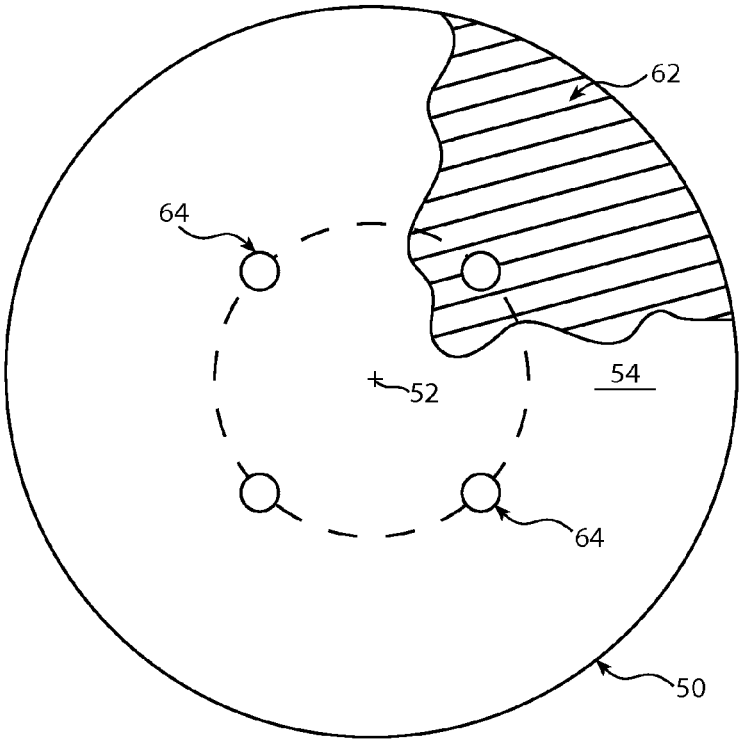
FIG. 6A includes a bottom view of a back-up pad in accordance with an embodiment.
Figure 6B:
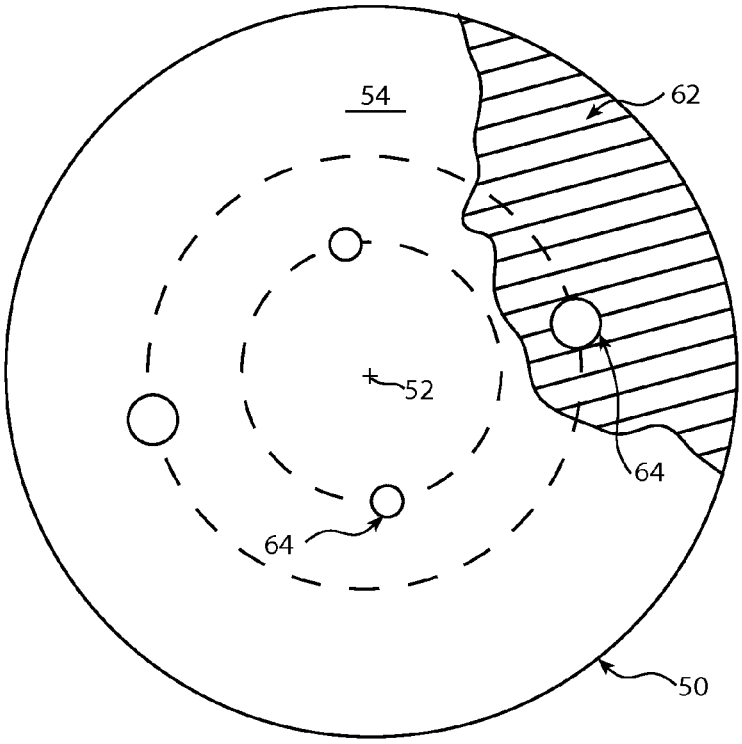
FIG. 6B includes a bottom view of a back-up pad in accordance with an embodiment.

As shown in FIGS. 6A and 6B, in certain embodiments, the back-up pad 50 can comprise a plurality of alignment elements 64. In such a manner, there may be at least two alignment elements, such as at least three alignment elements, at least four alignments elements, at least five alignment elements, or even at least ten alignment elements. Each alignment element 64 can extend from the first surface 54 of the back-up pad 50 a discrete distance.

To prevent wobble or eccentric oscillation, the plurality of alignment elements 64 can be positioned in rotational symmetry about the central axis 52. In a particular aspect, each alignment element 64 of the plurality of alignment elements 64 can have a mirroring alignment element 64 having the same weight and shape positioned 180 degrees around the central axis 52 of the back-up pad 50. In such a manner, the abrasive assembly 2 can symmetrically rotate about the central axis 52 free of axial wobble or eccentric oscillation. Alternatively, each one of the alignment elements 64 can have a different weight and/or shape and can be positioned in a non-geometrical rotational alignment.

As shown in FIG. 6B, the alignment elements 64 can have staggered radial distances from the central axis 52. The alignment elements 64 can be positioned in discrete concentric configuration (as shown) or in any other configuration.

Figure 3A:
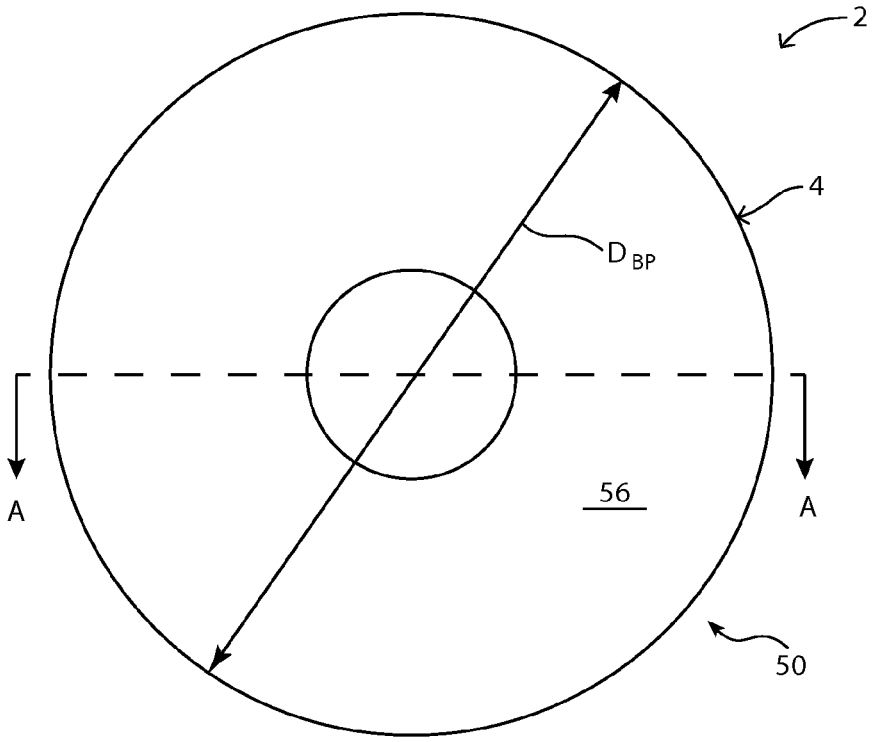
FIG. 3A includes a top view of an abrasive assembly in accordance with an embodiment.
Figure 3B:
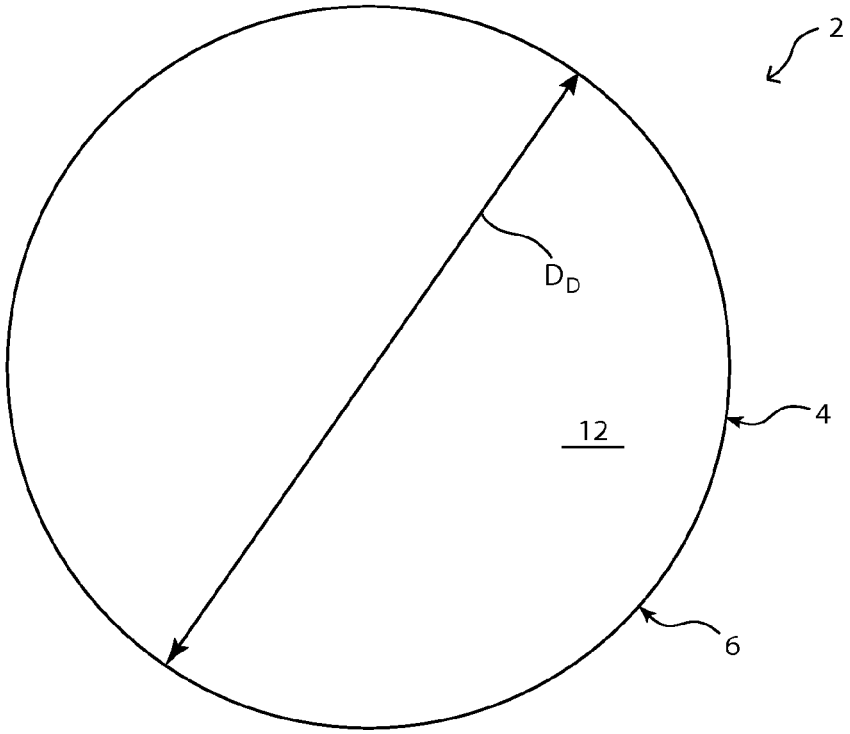
FIG. 3B includes a bottom view of an abrasive assembly in accordance with an embodiment.

FIG. 3A shows a top view of the abrasive assembly 2 (the second surface 56 of the back-up pad 50). FIG. 3B shows a bottom view of the abrasive assembly 2 (the second surface 12 of the abrasive disc 6). In particular embodiments, the abrasive assembly 2 can have a generally ellipsoidal outer edge 4 when viewed from one of the second surfaces 12 and 56 of the abrasive disc or back-up pad 6 and 50. In more particular embodiments, the abrasive assembly 2 can have a substantially circular outer edge 4 when viewed from one of the second surfaces 12 and 56 of the abrasive disc or back-up pad 6 and 50. In yet more particular embodiments, the abrasive assembly 2 can have a circular outer edge 4 when viewed from one of the second surfaces 12 and 56 of the abrasive disc or back-up pad 6 and 50. In a most preferred aspect, the abrasive assembly 2 is rotationally symmetrical so as to minimize or eliminate eccentric oscillation and wobble during rotation about the central axis 52.

In particular embodiments, the abrasive disc 6 can comprise a diameter, $D_D$, as measured by a distance between diametrically opposite locations of the second surface 12 of the abrasive disc 6 when viewed in a plane perpendicular thereto. The back-up pad 50 can comprise a diameter, $D_{BP}$, as measured by a distance between diametrically opposite locations of the first surface of the back-up pad 50 when viewed in a plane perpendicular thereto. In certain embodiments, $D_D$ can be greater than $D_{BP}$, such as, for example, $D_D$ can be greater than about 1.0 $D_{BP}$, greater than about 1.2 $D_{BP}$, greater than about 1.3 $D_{BP}$, greater than about 1.4 $D_{BP}$, or greater than about 1.5 $D_{BP}$. In yet other embodiments, $D_D$ can be equal to $D_{BP}$. In yet further, non-limiting embodiments, $D_{BP}$ can be greater than $D_D$, such as greater than about 1.1 $D_D$, greater than about 1.2 $D_D$, or even greater than about 1.3 $D_D$. In such embodiments, the back-up pad 50 may have a non-linear radial edge to facilitate edge grinding of the abrasive disc 6. In further embodiments, $D_D$ can be within a range between and including any of the values described above, such as, for example, between about 1.0 $D_{BP}$ and about 1.5 $D_{BP}$.

Abrasive Assembly

Referring again to FIGS. 1A and 1B, an advantage of embodiments of the herein described abrasive assembly 2 is an enhanced (i.e., small) concentricity, C, between the abrasive disc 6 and the back-up pad 50 and corresponding reduction of wobble and eccentric rotation therebetween during rotational operation of the abrasive assembly 2. More specifically, embodiments of the described abrasive disc 6 and back-up pad 50 can have a reduced concentricity tolerance around the central axis 8 of the abrasive disc 6 and the central axis 52 of the back-up pad 50.

In particular embodiments, the concentricity, C, of the abrasive assembly 2, as measured between the central axes 8 and 52 of the back-up pad and the abrasive disc 6, can be no greater than about 0.1, such as, no greater than about 0.05, no greater than about 0.02, no greater than about 0.01, no greater than about 0.005, no greater than about 0.001, or even no greater than about 0.0005. In further embodiments, the abrasive assembly 2 can have a concentricity of approximately 0.0 (i.e., coaxial). Moreover, in yet further embodiments, C can be within a range between and including any of the values described above, such as, for example, between about 0.01 and about 0.03.

In a particular aspect, the abrasive assembly 2 can maintain concentricity, C, during rotational usage (i.e., concentricity of the abrasive assembly 2 prior to work piece manipulation and after work piece manipulation can be equal, or substantially equal). In this regard, not only can the alignment elements 16 and 64 facilitate a more concentric assembly of the back-up pad 50 with the abrasive disc 6, but they can also facilitate continued concentricity during usage of the assembly. This may prevent the abrasive disc 6 from translating, or "walking," relative to the back-up pad 50, during rotational operation. In this regard, as contemplated in a particular embodiment herein, concentricity, C, can be measured before and/or after the abrasive assembly 2 is rotationally operated.

Concentricity of the abrasive assembly 2 can be measured by the radial distance between the axes 8 and 52. Alternatively, concentricity can be calculated using Total Indicated Runout ("runout"), or TIR.

TIR is a measure of the concentricity at the diameter of an object. TIR can be calculated using a test indicator such as a dial test indicator. To measure TIR, the abrasive assembly 2 is first placed on a spindle such that the assembly 1 can rotate about the central axis of the back-up pad. A (ball) tip of the dial test indicator is brought into contact with the outer edge of the abrasive disc. A pre-load (e.g., 0.015 in.) can optionally be affected on the dial test indicator (i.e., the ball tip can be forced to recede a distance, e.g., 0.015 in., into the dial test indicator. The dial test indicator is then secured in place such that only the ball tip can translate. The spindle is rotated until the minimum indicated deflection point (the rotational angle at which the dial test indicator has the lowest radial displacement) is found. After locating the minimum indicated deflection point, the dial test indicator is set to a "0.0" reading (or as close thereto as possible, recording the indicated value). The back-up pad is then rotated 180 degrees, or to the maximum indicated deflection point as indicated by the dial test indicator. The value indicated is recorded and the initial minimum indicated deflection value (if not 0.0) is subtracted therefrom. The resulting calculation is a measure of the TIR. Multiplying this result by 0.5 reveals the concentricity of the back-up pad and the abrasive article.

Figure 7A:
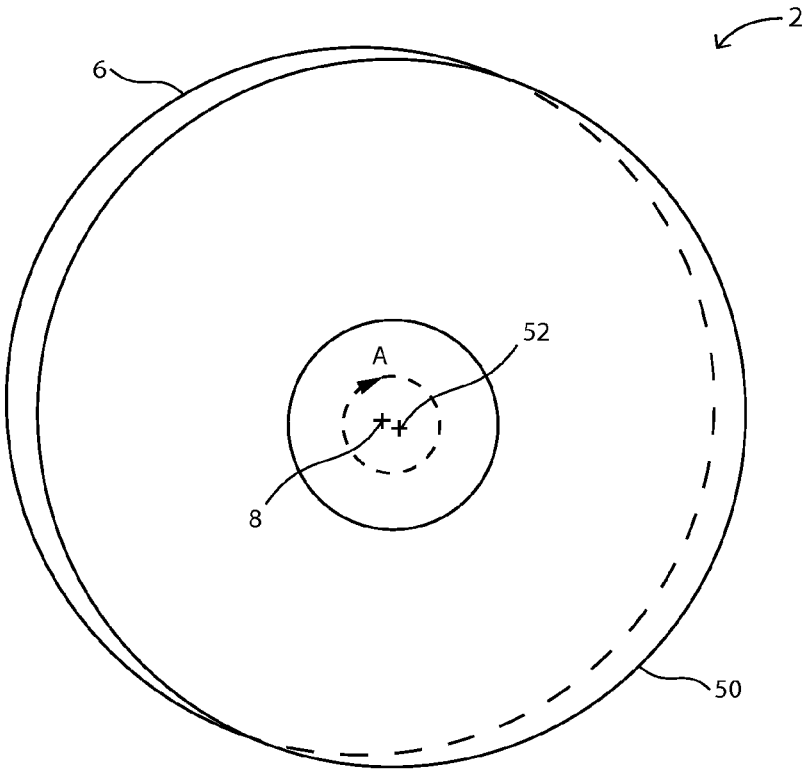
FIG. 7A includes a top view of a non-centered abrasive assembly.

FIG. 7A shows a top view of a non-centered abrasive assembly 2. The central axes 52 and 8 of the back-up pad 50 and abrasive disc 6, respectively, are out of axial alignment (i.e., not concentric). As a result, any rotation affected on the abrasive assembly 2 along the central axis 52 (the driving axis of the assembly 2) of the back-up pad 50 may result in eccentric oscillation and wobble of the abrasive assembly 2. Wobble and eccentric oscillation of the abrasive assembly 2 may create a less than desirable surface characteristic (e.g., swirls and pock marks) of the work piece (not shown).

Figure 7B:
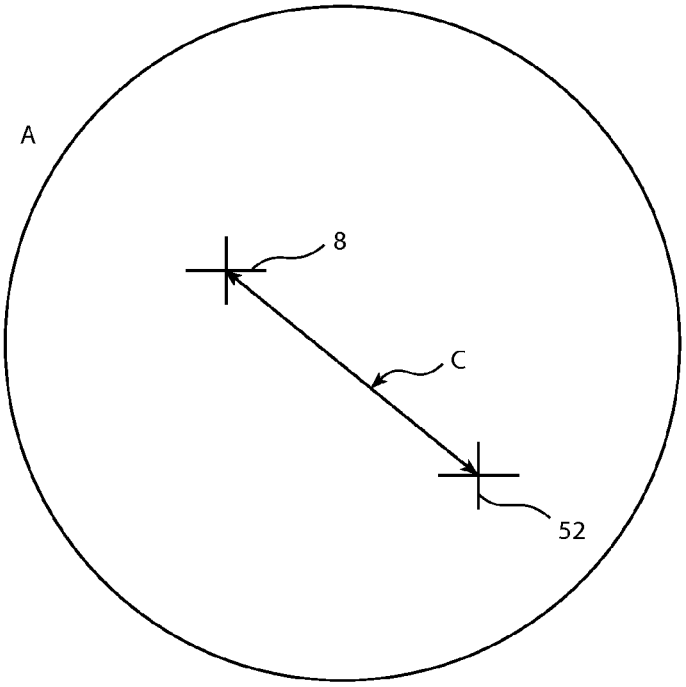
FIG. 7B includes an expanded top view of a non-centered abrasive assembly as seen in Circle A of FIG. 7A.

FIG. 7B shows an enlarged view as seen in Circle A of FIG. 7A. The concentricity between the axes 8 and 52 is represented by line C.

Figure 8A:
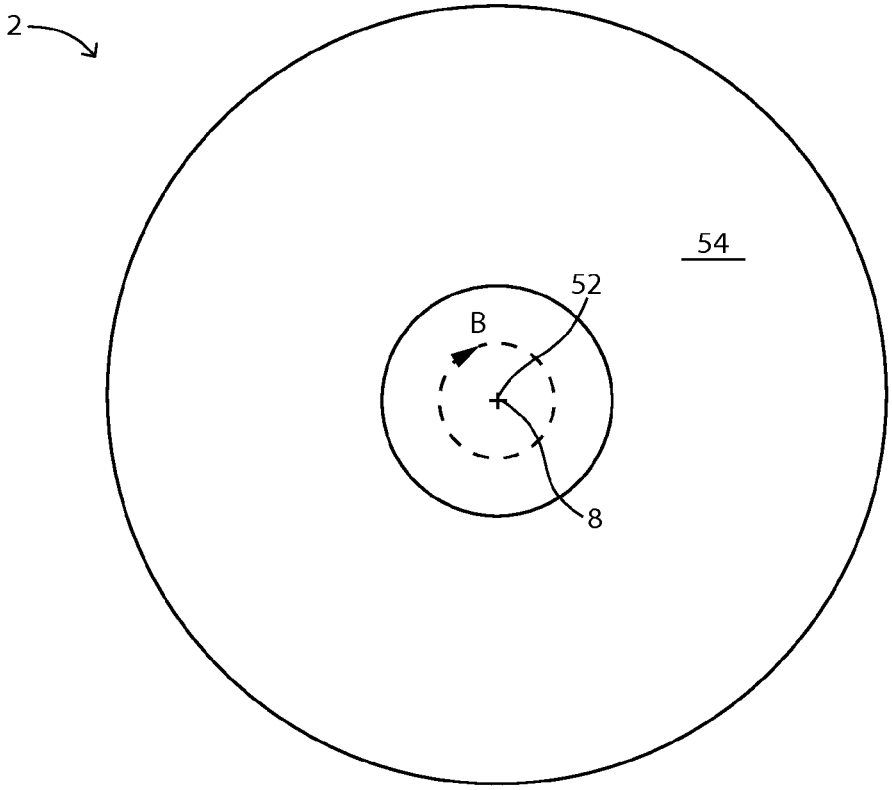
FIG. 8A includes a top view of a centered abrasive assembly in accordance with an embodiment.

FIG. 8A shows a top view of an abrasive assembly 2 in accordance with an embodiment herein. The central axes 52 and 8 of the back-up pad 50 and abrasive disc (below back-up pad 50), respectively, are more closely in alignment, thereby creating a more concentric abrasive assembly 2. In particular, the more precise axial alignment between the back-up pad 50 and the abrasive disc can be a product of the alignment elements 52 and 8 of the back-up pad 50 and the abrasive disc, respectively.

Figure 8B:
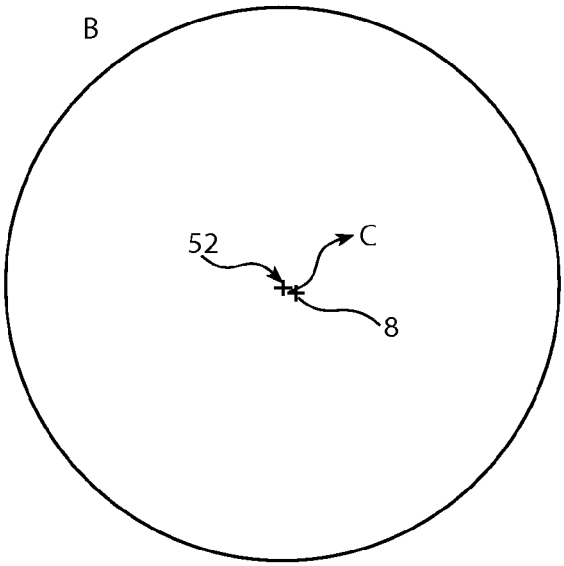
FIG. 8B includes an expanded top view of a centered abrasive assembly as seen in Circle B of FIG. 8A in accordance with an embodiment.

FIG. 8B shows an enlarged view as seen in Circle B of FIG. 8A. The concentricity between the axes 8 and 52 is represented at location C. As should be obvious to one having ordinary skill in the art, the abrasive assembly as shown in FIG. 7A has a larger concentricity error (i.e., is less coaxial) as compared to the abrasive assembly 2 utilizing an embodiment of the present invention, as seen in FIG. 8A.

In particular embodiments, the herein described abrasive assembly 2 can further exhibit a low standard deviation of concentricity as seen between a plurality of abrasive assemblies 2. In a certain embodiment, the standard deviation of concentricity, C, between the plurality of assemblies can be no greater than about 0.045, such as no greater than about 0.040, no greater than about 0.035, no greater than about 0.030, no greater than about 0.025, no greater than about 0.020, no greater than about 0.015, no greater than about 0.010, or even no greater than about 0.005. In this regard, the concentricity tolerance between the abrasive disc and the back-up pad can be readily reproduced between a plurality of abrasive assemblies 2, thus affording greater uniformity and consistency between assemblies.

Referring now to FIGS. 1A through 8B, in a certain aspect, to affect a low standard deviation (e.g., 0.005), the tolerances of the alignment elements 16 and 64 can be reduced. For example, in a particular aspect, a radial gap 30 can form between the alignment elements 16 and 64 when the abrasive assembly 2 is assembled. In certain embodiments, the radial gap 30 can be reduced (i.e., made smaller), thereby affecting a tighter fit between the alignment elements 16 and 64. In another aspect, the distances ($D_R$, $H_P$, $W_P$, and $W_R$) of the projection 24 or 72 and/or recess 18 or 66 can be made larger or smaller in order to affect greater or reduced surface contact between the abrasive disc 6 and the back-up pad 50.

In a further aspect, the angles of the outer surface of the alignment elements 16 and 64 can be made polygonal rather than ellipsoidal or circular in order to affect a more precise alignment control parameter.

Certain embodiments herein directed pertain to an abrasive assembly that can provide enhanced concentricity between an abrasive disc and a back-up pad while simultaneously affecting a fast engagement therebetween. Other embodiments are directed to an abrasive disc having at least two radially outer edges that can be selectively exposed for work piece manipulation. These embodiments, as described, can be used independently or in combination.

Items Category 1.

Item 1. An abrasive article comprising:

a disc including:

a central axis;

a primary outer edge substantially coaxial with the central axis and having a circumferential length, $L_1$;

a secondary outer edge substantially coaxial with the central axis and coplanar with the primary outer edge, the secondary outer edge having a circumferential length, $L_2$, wherein $L_2$ is less than $L_1$; and a structurally weakened portion extending substantially adjacent to the secondary outer edge.

Item 2. The abrasive article according to item 1, wherein the disc further comprises a first surface and a second surface opposite the first surface, and wherein the first and second surfaces define a thickness, $T_D$, as measured by a distance between the first and second surfaces.

Item 3. The abrasive article according to any one of items 1 or 2, wherein the disc comprises a non-woven abrasive.

Item 4. The abrasive article according to any one of items 1-3, wherein the structurally weakened portion is substantially coaxial with the central axis of the disc.

Item 5. The abrasive article according to any one of items 1-4, wherein the structurally weakened portion is coaxial with the central axis of the disc.

Item 6. The abrasive article according to any one of items 1-5, wherein the structurally weakened portion comprises a perforation extending at least partially through the disc in a direction generally parallel to the central axis.

Item 7. The abrasive article according to item 6, wherein the perforation extends fully through the disc.

Item 8. The abrasive article according to any one of items 1-7, wherein the structurally weakened portion comprises a plurality of perforations extending at least partially through the disc in a direction generally parallel to the central axis.

Item 9. The abrasive article according to item 8, wherein at least one perforation of the plurality of perforations extends fully through the disc.

Item 10. The abrasive article according to any one of items 1-9, wherein the structurally weakened portion includes a shedable portion, and wherein the shedable portion is configured to rupture the structurally weakened portion when the shedable portion is removed from the structurally weakened portion.

Item 11. The abrasive article according to any one of items 1-10, wherein the structurally weakened portion is configured to remain intact upon application of a torque around the central axis of no less than about 5 Nm, no less than about 10 Nm, no less than about 50 Nm, no less than about 100 Nm, or no less than about 500 Nm.

Item 12. The abrasive article according to any one of items 1-11, wherein the structurally weakened portion is configured to rupture upon application of a torque around the central axis of no greater than about 10,000 Nm, no greater than about 5,000 Nm, no greater than about 2,500 Nm, no greater than about 1,000 Nm, or no greater than about 500 Nm.

Item 13. The abrasive article according to any one of items 2-12, wherein the disc further comprises an engagement component disposed at least partially on the first surface.

Item 14. The abrasive article according to any one of items 2-13, wherein the disc further comprises an engagement component disposed along the entire first surface.

Item 15. The abrasive article according to any one of items 13 or 14, wherein the engagement component comprises one of a hook and a loop of a hook-and-loop engagement system, wherein the one of a hook and a loop of the hook-and-loop engagement system is configured to engage with the other one of a hook and a loop of a hook-and-loop engagement system positioned on a back-up pad.

Item 16. The abrasive article according to any one of items 2-15, wherein the primary outer edge has an exposed height, $H_{OE}$, as viewed perpendicular to a cross-section thereof, and wherein $H_{OE}$ is no greater than about 2.0 $T_D$, no greater than about 0.95 $T_D$, no greater than about 0.90 $T_D$, no greater than about 0.85 $T_D$, no greater than about 0.80 $T_D$, no greater than about 0.75 $T_D$.

Item 17. The abrasive article according to item 16, wherein $H_{OE}$ is no less than about 0.1 $T_D$, no less than about 0.2 $T_D$, no less than about 0.3 $T_D$.

Item 18. The abrasive article according to any one of items 16 or 17, wherein the secondary outer edge has an exposed length, $H_{SOE}$, as viewed perpendicular to a cross-section thereof, and wherein $H_{SOE}$ is no greater than about 2.0 $T_D$, no greater than about 0.95 $T_D$, no greater than about 0.90 $T_D$, no greater than about 0.85 $T_D$, no greater than about 0.80 $T_D$, no greater than about 0.75 $T_D$.

Item 19. The abrasive article according to item 18, wherein $H_{SOE}$ is no less than about 0.1 $T_D$, no less than about 0.2 $T_D$, no less than about 0.3 $T_D$.

Item 20. The abrasive article according to any one of items 1-19, wherein the disc further comprises a tertiary outer edge substantially coaxial with the central axis and coplanar with the second outer edge, the tertiary outer edge having a circumferential length, $L_3$, wherein $L_3$ is less than $L_2$.

Item 21. The abrasive article according to item 20, wherein the disc further comprises a second structurally weakened portion extending substantially adjacent to the tertiary outer edge.

Item 22. The abrasive article according to item 21, wherein the second structurally weakened portion is substantially coaxial with the central axis of the disc.

Item 23. The abrasive article according to any one of items 21 or 22, wherein the second structurally weakened portion is coaxial with the central axis of the disc.

Item 24. The abrasive article according to any one of items 21-23, wherein the second structurally weakened portion comprises a perforation extending at least partially through the disc in a direction generally parallel to the central axis.

Item 25. The abrasive article according to item 24, wherein the perforation extends fully through the disc.

Item 26. The abrasive article according to any one of items 21-25, wherein the second structurally weakened portion comprises a plurality of perforations extending at least partially through the disc in a direction generally parallel to the central axis.

Item 27. The abrasive article according to item 26, wherein at least one perforation of the plurality of perforations extends fully through the disc.

Item 28. The abrasive article according to any one of items 21-27, wherein the second structurally weakened portion includes a shedable portion, and wherein the shedable portion is configured to rupture the second structurally weakened portion when the shedable portion is removed from the second structurally weakened portion.

Item 29. The abrasive article according to any one of items 21-28, wherein the second structurally weakened portion is configured to remain intact upon application of a torque around the central axis of no less than about 5 Nm, no less than about 10 Nm, no less than about 50 Nm, no less than about 100 Nm, or no less than about 500 Nm.

Item 30. The abrasive article according to any one of items 21-29, wherein the second structurally weakened portion is configured to rupture upon application of a torque around the central axis of no greater than about 10,000 Nm, no greater than about 5,000 Nm, no greater than about 2,500 Nm, no greater than about 1,000 Nm, or no greater than about 500 Nm.

Item 31. An abrasive article comprising:

a primary disc having an outer edge defining an outer circumferential length, $L_1$, and having a central aperture having a circumferential length $L_2$; and a secondary disc attached to the primary disc, the secondary disc having an outer edge defining a circumferential length approximately equal to $L_2$;

wherein the outer edge of the primary disc is substantially coaxial and substantially coplanar with the outer edge of the secondary disc, wherein the primary disc is detachable from the secondary disc, and wherein the outer edge of the secondary disc is at least partially hidden by the primary disc prior to detachment of the primary disc from the secondary disc.

Item 32. The abrasive article according to item 31, wherein the primary and secondary discs comprises a non-woven abrasive.

Item 33. The abrasive article according to any one of items 31 or 32, wherein the secondary disc has a central aperture having a circumferential length, $L_3$.

Item 34. The abrasive article according to item 33, further comprising a tertiary disc attached to the secondary disc, the tertiary disc having an outer edge defining a circumferential length approximately equal to $L_2$, wherein the outer edge of the tertiary disc is substantially coaxial and substantially coplanar with the outer edge of the secondary disc, wherein the tertiary disc is detachable from the secondary disc, and wherein the outer edge of the tertiary disc is at least partially hidden by the secondary disc prior to detachment of the secondary disc from the tertiary disc.

Item 35. The abrasive article according to item 34, wherein the tertiary disc comprises a non-woven abrasive.

Item 36. An abrasive article having an initial outer circumferential length, $L_I$, and a length of deliberately exposable circumferential edge surface, $L_{OE}$, wherein $L_{OE}$ is greater than $L_I$.

Item 37. The abrasive article according to item 36, wherein $L_{OE}/L_I$ is no less than about 1.1, no less than about 1.2, no less than about 1.3, no less than about 1.4, no less than about 1.5, no less than about 1.7, no less than about 2.0, or no less than about 2.5.

Item 38. The abrasive article according to any one of items 36 or 37, wherein $L_{OE}/L_I$ is no greater than about 10.0, no greater than about 9.0, no greater than about 7.0, or no greater than about 5.0.

Item 39. The abrasive article according to any one of items 36-38, wherein the abrasive article comprises a disc including:

a central axis;

a primary outer edge substantially coaxial with the central axis and having a circumferential length, $L_1$;

a secondary outer edge substantially coaxial with the central axis and coplanar with the primary outer edge, the secondary outer edge having a circumferential length, $L_2$, wherein $L_2$ is less than $L_1$; and a structurally weakened portion extending substantially adjacent to the secondary outer edge.

Item 40. The abrasive article according to item 39, wherein the disc further comprises a first surface and a second surface opposite the first surface, and wherein the first and second surfaces define a thickness, $T_D$, as measured by a distance therebetween.

Item 41. The abrasive article according to any one of items 39 or 40, wherein the abrasive article further comprises a tertiary outer edge substantially coaxial with the central axis and coplanar with the second outer edge, the tertiary outer edge having a circumferential length, $L_3$, wherein $L_3$ is less than $L_2$.

Item 42. The abrasive article according to any one of items 36-41, wherein the abrasive article comprises a non-woven abrasive.

Item 43. An abrasive article comprising a disc defining a central axis and having a structurally weakened portion substantially coaxial with the central axis.

Item 44. The abrasive article according to item 43, wherein the structurally weakened portion is substantially coaxial with the central axis of the disc.

Item 45. The abrasive article according to any one of items 43 or 44, wherein the structurally weakened portion is coaxial with the central axis of the disc.

Item 46. The abrasive article according to any one of items 43-45, wherein the structurally weakened portion comprises a perforation extending at least partially through the disc in a direction generally parallel to the central axis.

Item 47. The abrasive article according to item 46, wherein the perforation extends fully through the disc.

Item 48. The abrasive article according to any one of items 43-47, wherein the structurally weakened portion comprises a plurality of perforations extending at least partially through the disc in a direction generally parallel to the central axis.

Item 49. The abrasive article according to item 48, wherein at least one perforation of the plurality of perforations extends fully through the disc.

Item 50. The abrasive article according to any one of items 43-49, wherein the structurally weakened portion includes a shedable portion, and wherein the shedable portion is configured to rupture the structurally weakened portion when the shedable portion is removed from the structurally weakened portion.

Item 51. The abrasive article according to any one of items 43-50, wherein the structurally weakened portion is configured to remain intact upon application of a torque around the central axis of no less than about 5 Nm, no less than about 10 Nm, no less than about 50 Nm, no less than about 100 Nm, or no less than about 500 Nm.

Item 52. The abrasive article according to any one of items 43-51, wherein the structurally weakened portion is configured to rupture upon application of a torque around the central axis of no greater than about 10,000 Nm, no greater than about 5,000 Nm, no greater than about 2,500 Nm, no greater than about 1,000 Nm, or no greater than about 500 Nm.

Item 53. An abrasive disc comprising:

a substantially cylindrical substrate defining a central axis and a thickness, $T_D$, as measured between a first surface and a second surface opposite the first surface, wherein the substantially cylindrical substrate comprises a non-woven abrasive;

a primary outer edge extending along the thickness, $T_D$, of the substantially cylindrical substrate, the primary outer edge being a radial distance, $D_P$, from the central axis of the substantially cylindrical substrate, wherein the primary outer edge is substantially coaxial with the central axis of the substantially cylindrical substrate;

a weakened portion extending at least partially along the thickness, $T_D$, of the substantially cylindrical substrate, the weakened portion comprising a plurality of perforations substantially coaxial with the central axis of the substantially cylindrical substrate, the weakened portion being a radial distance, $D_W$, from the central axis of the substantially cylindrical substrate, wherein $D_W$ is less than $D_P$; and a notional outer edge adjacent to the weakened portion, the notional outer edge extending along the thickness, $T_D$, of the substantially cylindrical substrate, the notional outer edge being a radial distance, $D_N$, from the central axis of the substantially cylindrical substrate, wherein $D_N$ is less than $D_W$.

Items Category 2.

Item 1. An abrasive assembly comprising:

a back-up pad having a central axis, an engagement component, and an alignment element; and an abrasive disc engaged with the back-up pad, the abrasive disc including an alignment element;

wherein the alignment element of the back-up pad aligns with the alignment element of the abrasive disc, wherein the engagement component of the back-up pad engages with the abrasive disc, and wherein the back-up pad and the abrasive disc have a concentricity tolerance, C, as measured between the central axis of the back-up pad and the abrasive disc, of no greater than about 0.1.

Item 2. A back-up pad for an abrasive article comprising:

a substrate having a first surface;

an engagement component disposed on the first surface; and an alignment element disposed on the first surface, wherein the back-up pad is configured to secure an abrasive disc adjacent to the first surface, the abrasive disc having an engagement component configured to secure to the engagement component of the back-up pad, and an alignment element configured to align with the alignment element of the back-up pad, and wherein the back-up pad is configured to have a concentricity tolerance, C, as measured between a central axis of the back-up pad and a central axis of the abrasive disc, of no greater than about 0.1.

Item 3. An abrasive disc comprising:

a substrate having a first surface and a second surface;

an engagement component disposed on the first surface; and an alignment element disposed on the first surface, wherein the abrasive disc is configured to secure with a back-up pad along the first surface, the back-up pad having an engagement structure configured to engage with the engagement component of the abrasive disc, and an alignment element configured to align with the alignment element of the abrasive disc, and wherein the abrasive disc is configured to have a concentricity tolerance, C, as measured between a central axis of the back-up pad and a central axis of the abrasive disc, of no greater than about 0.1.

Item 4. The abrasive assembly according to item 1, wherein the abrasive disc further comprises an engagement component, the engagement component of the abrasive disc engageable with the engagement component of the back-up pad.

Item 5. The abrasive assembly according to any one of items 1 or 4, wherein the back-up pad comprises a substrate having a first surface, and wherein the abrasive disc comprises a substrate having a first and a second surface.

Item 6. The abrasive assembly according to item 5, wherein the alignment element of the back-up pad is disposed on the first surface of the back-up pad.

Item 7. The back-up pad, abrasive disc, or abrasive assembly according to any one of the preceding items, wherein the alignment element of the back-up pad comprises a recess extending partially into the back-up pad substantially parallel with the central axis.

Item 8. The back-up pad, abrasive disc, or abrasive assembly according to any one of the preceding items, wherein the alignment element of the back-up pad comprises a recess having a generally frustoconical shape.

Item 9. The back-up pad, abrasive disc, or abrasive assembly according to any one of the preceding items, wherein the alignment element of the back-up pad comprises a recess extending into the back-up pad a depth, $D_R$, wherein the back-up pad comprises a thickness, $T_{BP}$, and wherein $D_R/T_{BP}$ is no greater than 1.0, less than 0.95, less than 0.90, less than 0.80, less than 0.75, or less than 0.50.

Item 10. The back-up pad, abrasive disc, or abrasive assembly according to item 9, wherein $D_R/T_{BP}$ is no less than 0.10, no less than 0.25, no less than 0.30, no less than 0.40, or no less than 0.50.

Item 11. The abrasive assembly according to item 1, wherein the alignment element of the abrasive disc is disposed on the first surface of the abrasive disc.

Item 12. The back-up pad, abrasive disc, or abrasive assembly according to any one of the preceding items, wherein the alignment element of the abrasive disc comprises a projection.

Item 13. The back-up pad, abrasive disc, or abrasive assembly according to any one of the preceding items, wherein the alignment element of the abrasive disc comprises a projection having a generally frustoconical shape.

Item 14. The back-up pad, abrasive disc, or abrasive assembly according to item 13, wherein the projection has a generally rounded tip.

Item 15. The back-up pad, abrasive disc, or abrasive assembly according to any one of items 13 or 14, wherein the alignment element of the abrasive disc comprises a height, Hp, as measured by a maximum distance the alignment element extends in a direction parallel with the central axis of the abrasive disc, wherein the abrasive disc has a thickness, $T_D$, and wherein $H_P$ is no less than 0.1 $T_D$, no less than 0.25 $T_D$, no less than 0.50 $T_D$, no less than 0.75 $T_D$, no less than 1.0 $T_D$, or no less than 1.25 $T_D$.

Item 16. The back-up pad, abrasive disc, or abrasive assembly according to item 15, wherein Hp is no greater than 2.0 $T_D$, no greater than 1.75 $T_D$, no greater than 1.5 $T_D$, or no greater than 1.25 $T_D$.

Item 17. The back-up pad, abrasive disc, or assembly according to any one of the preceding items, wherein the engagement component comprises a hook-and-loop engagement system.

Item 18. The back-up pad, abrasive disc, or abrasive assembly according to any one of the preceding items, wherein the engagement component comprises an adhesive.

Item 19. The back-up pad, abrasive disc, or abrasive assembly according to any one of the preceding items, wherein the engagement components of the back-up pad and the abrasive disc are disposed at least partially along the first surfaces of the back-up pad and the abrasive disc.

Item 20. The back-up pad, abrasive disc, or abrasive assembly according to any one of the preceding items, wherein the engagement components of the back-up pad and the abrasive disc are disposed substantially along the first surfaces of the back-up pad and the abrasive disc.

Item 21. The back-up pad, abrasive disc, or abrasive assembly according to any one of the preceding items, wherein the engagement components of the back-up pad and the abrasive disc are disposed along the entire first surfaces of the back-up pad and abrasive disc.

Item 22. The back-up pad, abrasive disc, or abrasive assembly according to any one of the preceding items, wherein the back-up pad and the abrasive disc each have an ellipsoidal shape when viewed along a plane perpendicular to the first surfaces of the back-up pad and the abrasive disc.

Item 23. The back-up pad, abrasive disc, or abrasive assembly according to any one of the preceding items, wherein the back-up pad and the abrasive disc each have a substantially circular shape when viewed along a plane perpendicular to the first surfaces of the back-up pad and the abrasive disc.

Item 24. The back-up pad, abrasive disc, or abrasive assembly according to any one of the preceding items, wherein the abrasive disc has a diameter, $D_D$, as measured by a distance between diametrically opposite locations of the first surface of the abrasive disc when viewed in a plane perpendicular thereto, wherein the back-up pad has a diameter, $D_{BP}$, as measured by a distance between diametrically opposite locations of the first surface of the back-up pad when viewed in a plane perpendicular thereto, and wherein $D_D$ is no less than $D_{BP}$.

Item 25. The back-up pad, abrasive disc, or abrasive assembly according to item 24, wherein $D_D$ is greater than 1.0 $D_{BP}$, greater than 1.1 $D_{BP}$, greater than 1.2 $D_{BP}$, greater than 1.3 $D_{BP}$, greater than 1.4 $D_{BP}$ or greater than 1.5 $D_{BP}$.

Item 26. The back-up pad, abrasive disc, or abrasive assembly according to any one of items 24 or 25, wherein $D_D$ is equal to $D_{BP}$.

Item 27. The back-up pad, abrasive disc, or abrasive assembly according to any one of items 3-26, wherein the second surface of the abrasive disc is generally flat as seen in a cross-section between diametrically opposite locations of the abrasive disc.

Item 28. The back-up pad, abrasive disc, or abrasive assembly according to any one of the preceding items, wherein C is no greater than about 0.09, no greater than about 0.05, no greater than about 0.01, no greater than about 0.005, or no greater than about 0.001.

Item 29. The back-up pad, abrasive disc, or abrasive assembly according to any one of the preceding items, wherein C is no less than 0.

Item 30. The back-up pad, abrasive disc, or abrasive assembly according to any one of the preceding items, wherein C is measured after the back-up pad is engaged with the abrasive disc.

Item 31. The back-up pad, abrasive disc, or abrasive assembly according to any one of the preceding items, wherein the abrasive disc comprises a non-woven abrasive.

Item 32. The back-up pad, abrasive disc, or abrasive assembly according to any one of the preceding items, wherein the abrasive disc comprises a bonded abrasive.

Item 33. A plurality of back-up pads, including at least about 10 back-up pads, wherein each back-up pad of the plurality of back-up pads is configured to engage with an abrasive disc, wherein each back-up pad of the plurality of back-up pads is configured to have a concentricity tolerance, C, with the abrasive disc, as measured between a central axis of the back-up pad and a central axis of the abrasive disc, of no greater than about 0.1, and wherein C varies in the plurality of back-up pads by a standard deviation of no greater than about 0.075.

Item 34. The plurality of back-up pads according to item 33, wherein C is no greater than about 0.09, no greater than about 0.05, no greater than about 0.01, no greater than about 0.005, or no greater than about 0.001.

Item 35. The plurality of back-up pads according to any one of items 33 or 34, wherein C is no less than about 0.

Item 36. The plurality of back-up pads according to any one of items 33-35, wherein the plurality of back-up pads includes at least 15 back-up pads, at least 20 back-up pads, at least 30 back-up pads, at least 50 back-up pads, or at least 100 back-up pads.

Item 37. The plurality of back-up pads according to any one of items 33-36, wherein the standard deviation is no greater than about 0.05, no greater than about 0.01, no greater than about 0.005, or no greater than about 0.001.

Item 38. The plurality of back-up pads according to any one of items 33-37, wherein the standard deviation is no less than about 0.0001.

Item 39. The plurality of back-up pads according to any one of items 33-38, wherein each back-up pad of the plurality of back-up pads comprises:

a substrate having a first surface;

an engagement component disposed on the first surface; and an alignment element disposed on the first surface.

Item 40. The plurality of back-up pads according to item 39, wherein the alignment element is coaxial with the central axis of the back-up pad.

Item 41. The plurality of back-up pads according to any one of items 39 or 40, wherein the alignment element comprises a plurality of alignment elements.

Item 42. The plurality of back-up pads according to item 41, wherein the plurality of alignment elements comprise 2 alignment elements, 3 alignment elements, 4 alignment elements, 5 alignment elements, 6 alignment elements, 7 alignment elements, 8 alignment elements, 9 alignment elements, or 10 alignment elements.

Item 43. The plurality of back-up pads according to any one of items 41 or 42, wherein the plurality of alignment elements are disposed symmetrically about the central axis of the back-up pad.

Item 44. The plurality of back-up pads according to item 43, wherein the plurality of alignment elements are disposed on the first surface of the back-up pad in a rotationally symmetrical manner, as seen when viewed in a plane perpendicular to the first surface.

Item 45. The plurality of back-up pads according to any one of items 39-44, wherein the engagement component comprises a component of a hook-and-loop engagement system.

Item 46. The plurality of back-up pads according to item 45, wherein the engagement component comprises a plurality of hooks.

Item 47. The plurality of back-up pads according to item 45, wherein the engagement component comprises a plurality of loops.

Item 48. The plurality of back-up pads according to any one of items 39-47, wherein the engagement component comprises an adhesive.

Item 49. The plurality of back-up pads according to any one of items 39-48, wherein the engagement component is disposed at least partially along the first surface of the back-up pad.

Item 50. The back-up pad, abrasive disc, or abrasive assembly according to any one of items 39-49, wherein the engagement component is disposed substantially along the first surface of the back-up pad.

Item 51. The back-up pad, abrasive disc, or abrasive assembly according to any one of items 39-50, wherein the engagement component is disposed along the entire first surface of the back-up pad.

Item 52. A plurality of abrasive discs, including at least about 10 abrasive discs, wherein each abrasive disc of the plurality of abrasive discs is configured to engage with a back-up pad, wherein each abrasive disc of the plurality of abrasive discs is configured to have a concentricity tolerance, C, with the back-up pad, as measured between a central axis of the back-up pad and a central axis of the abrasive disc, of no greater than about 0.1, and wherein C varies in the plurality of back-up pads by a standard deviation of no greater than about 0.075.

Item 53. The plurality of abrasive discs according to item 52, wherein C is no greater than about 0.09, no greater than about 0.05, no greater than about 0.01, no greater than about 0.005, or no greater than about 0.001.

Item 54. The plurality of abrasive discs according to any one of items 52 or 53, wherein C is no less than about 0.

Item 55. The plurality of abrasive discs according to any one of items 52-54, wherein the plurality of abrasive discs includes at least 15 abrasive discs, at least 20 abrasive discs, at least 30 abrasive discs, at least 50 abrasive discs, or at least 100 abrasive discs.

Item 56. The plurality of abrasive discs according to any one of items 52-55, wherein the standard deviation is no greater than about 0.05, no greater than about 0.01, no greater than about 0.005, or no greater than about 0.001.

Item 57. The plurality of abrasive discs according to any one of items 52-56, wherein the standard deviation is no less than about 0.0001.

Item 58. The plurality of abrasive discs according to any one of items 52-57, wherein each abrasive disc of the plurality of abrasive discs comprises:

a substrate having a first surface;

an engagement component disposed on the first surface; and an alignment element disposed on the first surface.

Item 59. The plurality of abrasive discs according to item 58, wherein the alignment element is coaxial with the central axis of the abrasive disc.

Item 60. The plurality of abrasive discs according to any one of items 58 or 59, wherein the alignment element comprises a plurality of alignment elements.

Item 61. The plurality of abrasive discs according to item 60, wherein the plurality of alignment elements comprise 2 alignment elements, 3 alignment elements, 4 alignment elements, 5 alignment elements, 6 alignment elements, 7 alignment elements, 8 alignment elements, 9 alignment elements, or 10 alignment elements.

Item 62. The plurality of abrasive discs according to any one of items 60 or 61, wherein the plurality of alignment elements are disposed symmetrically about the central axis of the abrasive disc.

Item 63. The plurality of abrasive discs according to item 62, wherein the plurality of alignment elements are disposed on the first surface of the abrasive disc in a rotationally symmetrical manner, as seen when viewed in a plane perpendicular to the first surface.

Item 64. The plurality of abrasive discs according to any one of items 58-63, wherein the engagement component comprises a component of a hook-and-loop engagement system.

Item 65. The plurality of abrasive discs according to item 64, wherein the engagement component comprises a plurality of hooks.

Item 66. The plurality of abrasive discs according to item 64, wherein the engagement component comprises a plurality of loops.

Item 67. The plurality of abrasive discs according to any one of items 58-66, wherein the engagement component comprises an adhesive.

Item 68. The plurality of abrasive discs according to any one of items 58-67, wherein the engagement component is disposed at least partially along the first surface of the abrasive disc.

Item 69. The plurality of abrasive discs according to any one of items 58-68, wherein the engagement component is disposed substantially along the first surface of the abrasive disc.

Item 70. The plurality of abrasive discs according to any one of items 58-69, wherein the engagement component is disposed along the entire first surface of the abrasive disc.

Item 71. An abrasive disc assembly comprising:

a back-up pad including a first surface, a second surface opposite the first surface, and a central axis perpendicular to the first surface of the back-up pad, wherein the first surface of the back-up pad includes a first component of a hook-and-loop engagement structure at least substantially disposed thereon, wherein the first surface of the back-up pad includes an opening, the opening having a central axis, and wherein the central axis of the opening is substantially coaxial with the central axis of the central axis of the back-up pad; and an abrasive disc including a first surface, a second surface opposite the first surface and a central axis perpendicular to the second surface of the abrasive disc, wherein the second surface of the abrasive disc includes a second component of the hook-and-loop engagement structure at least substantially disposed thereon, wherein the second surface of the abrasive disc includes an alignment button, the alignment button having a central axis, and wherein the central axis of the alignment button is substantially coaxial with the central axis of the abrasive disc, wherein the first component of the hook-and-loop engagement structure is attached to the second component of the hook-and-loop engagement structure connecting the back-up pad to the abrasive disc, and wherein the central axis of the alignment button of the abrasive disc is substantially coaxial with the central axis of the opening of the back-up pad.

Item 72. The abrasive disc assembly according to item 71, wherein the central axis of the alignment button of the abrasive disc is coaxial with the central axis of the opening of the back-up pad.

Item 73. A plurality of abrasive disc assemblies in accordance with any one of items 71 or 72, wherein each abrasive disc assembly of the plurality of abrasive disc assemblies has a concentricity, C, of no greater than about 0.1, no greater than about 0.05, or no greater than about 0.001.

Item 74. A plurality of abrasive disc assemblies in accordance with item 73, wherein C varies in the plurality of abrasive disc assemblies by a standard deviation of no greater than about 0.075, no greater than about 0.05, no greater than about 0.01, no greater than about 0.005, or no greater than about 0.001.

The embodiments provide a combination of features, which can be combined in various matters to describe and define a method and system of the embodiments. The description is not intended to set forth a hierarchy of features, but different features that can be combined in one or more manners to define the invention. In the foregoing, reference to specific embodiments and the connection of certain components is illustrative. It will be appreciated that reference to components as being coupled or connected is intended to disclose either direct connected between said components or indirect connection through one or more intervening components as will be appreciated to carry out the methods as discussed herein.

As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The disclosure is submitted with the understanding that it will not be used to interpret or limit the scope or meaning of the claims. In addition, in the foregoing disclosure, various features may be grouped together or described in a single embodiment for the purpose of streamlining the disclosure. This disclosure is not to be interpreted as reflecting an intention that the embodiments herein limit the features provided in the claims, and moreover, any of the features described herein can be combined together to describe the inventive subject matter. Still, inventive subject matter may be directed to less than all features of any of the disclosed embodiments.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

The invention claimed is:

1. An abrasive article comprising:

a disc including:

a central axis;

a primary outer edge substantially coaxial with the central axis and having a circumferential length, L1;

a secondary outer edge substantially coaxial with the central axis and coplanar with the primary outer edge, the secondary outer edge having a circumferential length, L2, wherein L2 is less than L1;

a structurally weakened portion extending substantially adjacent to the secondary outer edge, wherein the structurally weakened portion comprises a plurality of perforations extending fully through the disc in a direction generally parallel to the central axis; and a shedable portion configured to rupture the structurally weakened portion when the shedable portion is removed from the abrasive disc.

2. The abrasive article according to claim 1, wherein the disc comprises a non-woven abrasive.

3. The abrasive article according to claim 1, wherein the structurally weakened portion is coaxial with the central axis of the disc.

4. The abrasive article according to claim 1, wherein the disc further comprises a tertiary outer edge substantially coaxial with the central axis and coplanar with the second outer edge, the tertiary outer edge having a circumferential length, L3, wherein L3 is less than L2.

5. The abrasive article according to claim 4, wherein the disc further comprises a second structurally weakened portion extending substantially adjacent to the tertiary outer edge.

6. The abrasive article according to claim 5, wherein the second structurally weakened portion is coaxial with the central axis of the disc.

7. The abrasive article according to claim 5, wherein the second structurally weakened portion comprises a plurality of perforations extending at least partially through the disc in a direction generally parallel to the central axis.

8. The abrasive article according to claim 5, further comprising:

a shedable portion configured to rupture the second structurally weakened portion when the shedable portion is removed from the second structurally weakened portion.

9. The abrasive article according to claim 5, wherein the second structurally weakened portion is configured to remain intact upon application of a torque around the central axis of no less than about 5 Nm.

10. The abrasive article according to claim 1, wherein the disc further comprises an engagement component disposed at least partially on a surface of the disc.

11. The abrasive article according to claim 1, wherein the abrasive article comprises a non-woven abrasive.

12. An abrasive article comprising:

a disc including:

a central axis;

a primary outer edge substantially coaxial with the central axis and having a circumferential length, L1;

a secondary outer edge substantially coaxial with the central axis and coplanar with the primary outer edge, the secondary outer edge having a circumferential length, L2, wherein L2 is less than L1;

a tertiary outer edge substantially coaxial with the central axis and coplanar with the second outer edge, the tertiary outer edge having a circumferential length, L3, wherein L3 is less than L2, and a structurally weakened portion extending substantially adjacent to the secondary outer edge, wherein the structurally weakened portion comprises a plurality of perforations extending fully through the disc in a direction generally parallel to the central axis, and a second structurally weakened portion extending substantially adjacent to the tertiary outer edge.

* * * * *